US006773856B2

(12) United States Patent
Tanaka et al.

(10) Patent No.: US 6,773,856 B2
(45) Date of Patent: Aug. 10, 2004

(54) ELECTROPHOTOGRAPHIC PHOTOSENSITIVE MEMBER, PROCESS CARTRIDGE, AND ELECTROPHOTOGRAPHIC APPARATUS

(75) Inventors: Masato Tanaka, Shizuoka (JP); Hideki Anayama, Shizuoka (JP); Hidetoshi Hirano, Shizuoka (JP); Atsushi Fujii, Shizuoka (JP); Ryuji Higashi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/285,467

(22) Filed: Nov. 1, 2002

(65) Prior Publication Data

US 2003/0143475 A1 Jul. 31, 2003

(30) Foreign Application Priority Data

Nov. 9, 2001 (JP) ..... 2001-344806

(51) Int. Cl.[7] ..... G03G 5/047
(52) U.S. Cl. ..... 430/59.2; 430/70
(58) Field of Search ..... 430/59.3, 59.1, 430/59.2, 70

(56) References Cited

U.S. PATENT DOCUMENTS

| | | | | |
|---|---|---|---|---|
| 4,898,799 | A | 2/1990 | Fujimaki et al. | 430/59 |
| 4,963,450 | A | 10/1990 | Miyazaki et al. | 430/59 |
| 5,302,479 | A | 4/1994 | Daimon et al. | 430/78 |
| 5,358,813 | A | 10/1994 | Iijima et al. | 430/59 |
| 5,885,737 | A | 3/1999 | Tanaka | 430/59 |
| 6,248,490 | B1 * | 6/2001 | Suzuki et al. | 430/69 |
| 6,335,132 | B1 | 1/2002 | Tanaka et al. | 430/59.3 |
| 6,465,143 | B2 * | 10/2002 | Tanaka et al. | 430/59.3 |
| 2002/0061454 | A1 | 5/2002 | Tanaka et al. | 430/59.2 |

FOREIGN PATENT DOCUMENTS

| | | |
|---|---|---|
| EP | 0743561 | 11/1996 |
| JP | 59-31962 | 2/1984 |
| JP | 61-217050 | 9/1986 |
| JP | 61-239248 | 10/1986 |
| JP | 62-67094 | 3/1987 |
| JP | 63-218768 | 9/1988 |
| JP | 1-17066 | 1/1989 |
| JP | 1-183663 | 7/1989 |
| JP | 5-98181 | 4/1993 |
| JP | 5-263007 | 10/1993 |
| JP | 5-271175 | 10/1993 |
| JP | 7-128888 | 5/1994 |
| JP | 9-34149 | 2/1997 |
| JP | 10-67946 | 3/1998 |
| JP | 2001-66814 | 3/2001 |
| JP | 2001-290293 | 10/2001 |

OTHER PUBLICATIONS

Patent Abstracts of Japan, vol. 1997, No. 7, Jul. 31, 1997 for JP 9–080779.

Yeh, et al.; Synthesis of 6–Amino–1,3–benzodioxin and Its ρ–Arylazo–Substituted Calix[4]arenes; J. Org. Chem. (1994), 59, 754–757.

Gu, et al.; Synthesis and Electronic Properties of Covalent Assemblies of Oligophenylenevinylene Units Arising from a Calix[4]arene Core; J. Org. Chem (2001), 66, 6432–6439.

* cited by examiner

*Primary Examiner*—John L Goodrow
(74) *Attorney, Agent, or Firm*—Fitzpatrick, Cella, Harper & Scinto

(57) ABSTRACT

An electrophotographic photosensitive member has a support and a photosensitive layer provided thereon. The photosensitive layer contains a carixarene compound having specific structure. Also disclosed are a process cartridge and an electrophotographic apparatus which have the electrophotographic photosensitive member.

38 Claims, 2 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, a process cartridge having the electrophotographic photosensitive member, and an electrophotographic apparatus.

2. Related Background Art

In recent years, copying machines and printers (electrophotographic apparatus) having applied electrophotography have come into wide use. These chiefly employ lasers as light sources. As the light sources, semiconductor lasers are used taking account of cost and the size of electrophotographic apparatus.

At present, semiconductor lasers used chiefly have its oscillation wavelengths of as long as 650 to 820 nm in wavelength. Accordingly, development and research have been put forward on electrophotographic photosensitive members having a sufficient sensitivity to such long-wavelength light. Recently, development and research are also being put forward on electrophotographic photosensitive members having a sufficient sensitivity to short-wavelength semiconductor lasers in order to achieve higher resolution.

Azo pigments and phthalocyanine pigments are very effective as charge-generating materials having sensitivity in such a long-wavelength region up to a short-wavelength region. Azo pigments having specific structure are disclosed in, e.g., Japanese Patent Applications Laid-open Nos. 59-31962 and 1-183663. Also, as the phthalocyanine pigments, oxytitanium phthalocyanine and gallium phthalocyanine have superior sensitivity characteristics, and their various crystal forms have ever been disclosed in, e.g., Japanese Patent Application Laid-open Nos. 61-239248, 61-217050, 62-67094, 63-218768, 64-17066, 5-98181, 5-263007 and 10-67946.

Japanese Patent Application Laid-open Nos. 7-128888 and 9-34149 also disclose that, in order to overcome problems in phthalocyanine pigments, they are used in combination with specific azo pigments.

However, such electrophotographic photosensitive members making use of azo pigments or phthalocyanine pigments have superior sensitivity characteristics as stated above, but on the other hand have had a disadvantage that photocarriers formed tend to remain in the photosensitive layer to tend to cause variations in potential as a sort of memory.

The mechanism of this phenomenon has not been ascertained, and is presumed as follows: For example, in the case of an electrophotographic photosensitive member having a multi-layer type photosensitive layer separated functionally into a charge generation layer and a charge transport layer, electrons left in the charge generation layer move to the interface between the charge generation layer and the charge transport layer for any reason. Also, in the case of an electrophotographic photosensitive member having an intermediate layer and a conductive layer, electrons left in the photosensitive layer (charge generation layer) move to the interface between the photosensitive layer (charge generation layer) and the intermediate layer or to the interface between the intermediate layer and the conductive layer for any reason. Such carriers enhance or lower the barrier properties against hole injection in the vicinity of the interface.

When actually used as an electrophotographic photosensitive member, the former case in which electrons collect at the interface between the charge transport layer and the charge generation layer appears as a decrease in light-area potential or residual potential at the time of continuous printing. For example, where the photosensitive member is used in a development process in which the part of dark-area potential is made to serve as non-development part and the part of light-area potential as development part (what is called a reversal-development system), which is widely used at present in laser beams printers, the areas to which the light has been applied at the time of earlier printing come high in sensitivity. Hence, what is called ghost may conspicuously appear which is a phenomenon that, when a whole-area white image is printed at the time of next printing, the part of the earlier printing looms in black (hereinafter "positive ghost").

In contrast, the latter case in which electrons collect at the interface between the intermediate layer and the conductive layer appears as an increase in light-area potential at the time of printing. Where the photosensitive member is used in the reversal-development system, the areas to which the light has been applied at the time of earlier printing come low in sensitivity. Hence, what is called ghost may conspicuously appear which is a phenomenon that, when a whole-area black image is printed at the time of next printing, the part of the earlier printing looms in white (hereinafter "negative ghost").

Of these phenomena, the negative ghost often appears at the initial stage of printing, and the positive ghost during continuous printing.

This phenomenon is remarkable especially in electrophotographic photosensitive members having the intermediate layer as an adhesion layer of the photosensitive layer (charge generation layer). Especially in an environment of, e.g., low temperature and low humidity, the charge generation layer and the intermediate layer may come to have a high volume resistance to electrons, and hence the electrons tend to come full in the charge generation layer to very tend to cause the phenomenon of ghost. There has been such a disadvantage.

Japanese Patent Application Laid-open Nos. 2001-66804 and 2001-290293 also disclose that a carixarene compound is used in order to prevent such ghost.

However, for the achievement of much higher image quality and color image formation required in recent years, it is desired to better prevent in every environment the image quality from deteriorating due to the phenomenon of ghost, and it is desired to much better prevent the image quality from deteriorating especially in a severe-condition low-temperature and low-humidity environment and as a result of running.

SUMMARY OF THE INVENTION

An object of the present invention is to solve the above problems to provide an electrophotographic photosensitive member which has a high sensitivity, has a high sensitivity especially in the semiconductor laser wavelength region, and also can form images having less image defects such as ghost, not only in a normal-temperature and normal-humidity environment but also in a low-temperature and low-humidity environment; and a process cartridge and an electrophotographic apparatus which have such an electrophotographic photosensitive member.

As a result of extensive studies, the present inventors have discovered that the above problems can be solved when a carixarene compound, in particular, a carixarene compound having specific structure is used in the photosensitive layer.

More specifically, the present invention is an electrophotographic photosensitive member comprising a support and a photosensitive layer provided thereon, wherein the photosensitive layer contains a carixarene compound having structure represented by any one formula selected from the group consisting of the following formulas (1) to (5).

(1)

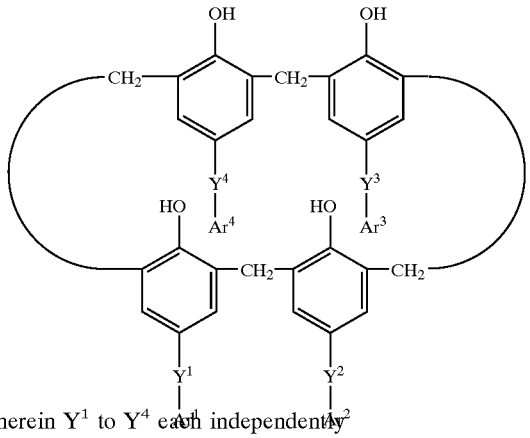

wherein $Y^1$ to $Y^4$ each independently represent —CH═N—, —CH═CH—, —N═N— or —N(O)═N—, and $Ar^1$ to $Ar^4$ each independently represent a substituted or unsubstituted aromatic hydrocarbon ring or a substituted or unsubstituted aromatic heterocyclic ring, provided that a case in which all the $Y^1$ to $Y^4$ are —N═N— and all the $Ar^1$ to $Ar^4$ are the same is excluded.

(2)

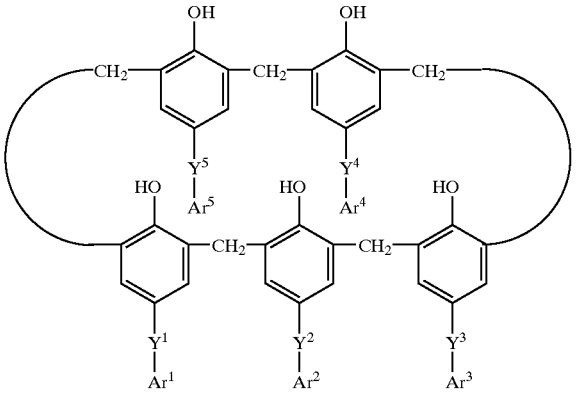

wherein $Y^1$ to $Y^5$ each independently represent —CH═N—, —CH═CH—, —N═N— or —N(O)═N—, and $Ar^1$ to $Ar^5$ each independently represent a substituted or unsubstituted aromatic hydrocarbon ring or a substituted or unsubstituted aromatic heterocyclic ring, provided that a case in which all the $Y^1$ to $Y^5$ are —N═N— and all the $Ar^1$ to $Ar^5$ are the same is excluded.

(3)

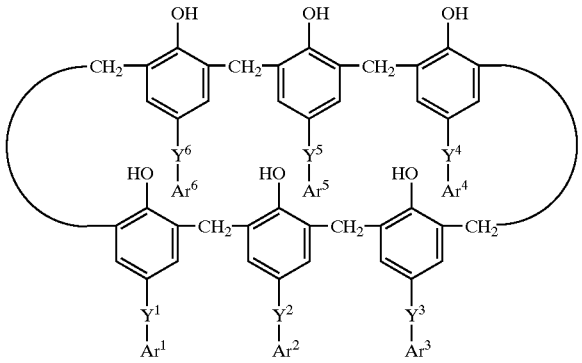

wherein $Y^1$ to $Y^6$ each independently represent —CH═N—, —CH═CH—, —N═N— or —N(O)═N—, and $Ar^1$ to $Ar^6$ each independently represent a substituted or unsubstituted aromatic hydrocarbon ring or a substituted or unsubstituted aromatic heterocyclic ring, provided that a case in which all the $Y^1$ to $Y^6$ are —N═N— and all the $Ar^1$ to $Ar^6$ are the same is excluded.

(4)

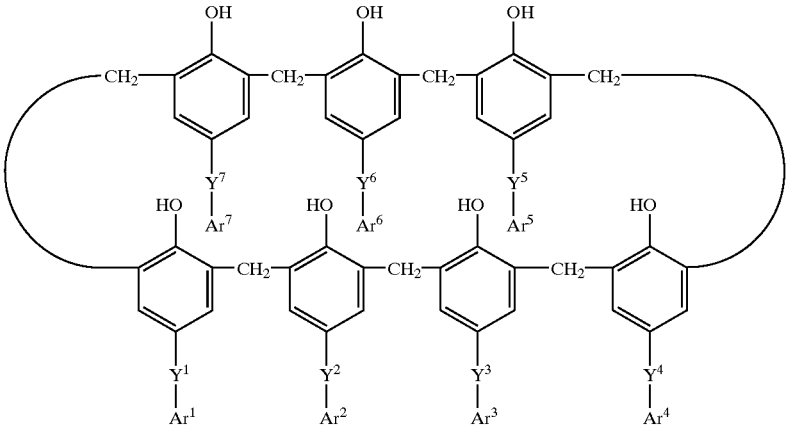

wherein $Y^1$ to $Y^7$ each independently represent —CH═N—, —CH═CH—, —N═N— or —N(O)═N—, and $Ar^1$ to $Ar^7$ each independently represent a substituted or unsubstituted aromatic hydrocarbon ring or a substituted or unsubstituted aromatic heterocyclic ring, provided that a case in which all the $Y^1$ to $Y^7$ are —N═N— and all the $Ar^1$ to $Ar^7$ are the same is excluded.

(5)

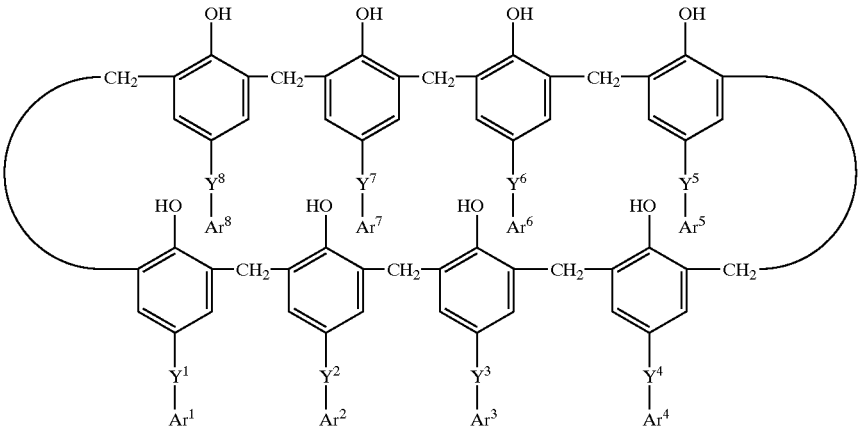

wherein $Y^1$ to $Y^8$ each independently represent —CH═N—, —CH═CH—, —N═N— or —N(O)═N—, and $Ar^1$ to $Ar^8$ each independently represent a substituted or unsubstituted aromatic hydrocarbon ring or a substituted or unsubstituted aromatic heterocyclic ring, provided that a case in which all the $Y^1$ to $Y^8$ are —N═N— and all the $Ar^1$ to $Ar^8$ are the same is excluded.

The present invention is also a process cartridge which integrally supports the above electrophotographic photosensitive member and at least one means selected from the group consisting of a charging means, a developing means, a transfer means and a cleaning means, and is detachably mountable to the main body of an electrophotographic apparatus.

The present invention is still also an electrophotographic apparatus comprising the above electrophotographic photosensitive member, a charging means, an exposure means, a developing means and a transfer means.

DETAILED DESCRIPTION OF THE INVENTION

Figure 1:
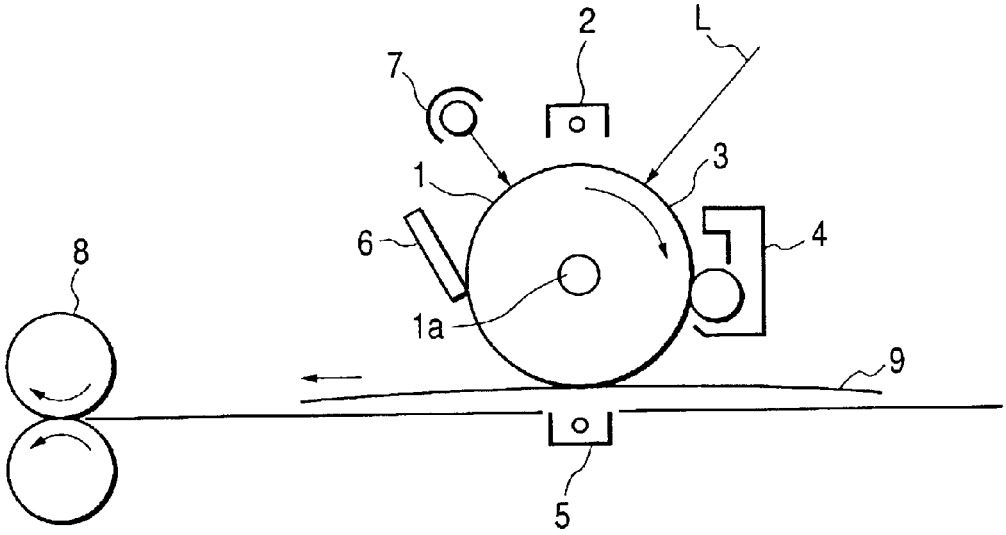
FIG. 1 is a schematic view showing an example of the construction of an electrophotographic apparatus having the electrophotographic photosensitive member of the present invention.

The carixarene compound used in the photosensitive layer of the electrophotographic photosensitive member according to the present invention has structure represented by any formula of the following formulas (1) to (5).

(1)

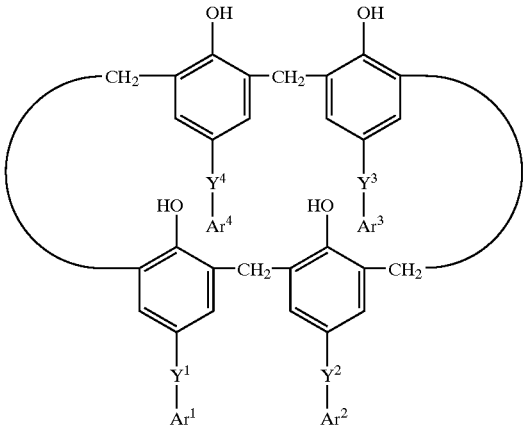

In the formula (1), $Y^1$ to $Y^4$ each independently represent —CH═N—, —CH═CH—, —N═N— or —N(O)═N—, and $Ar^1$ to $Ar^4$ each independently represent a substituted or unsubstituted aromatic hydrocarbon ring or a substituted or unsubstituted aromatic heterocyclic ring, provided that a case in which all the $Y^1$ to $Y^4$ are —N═N— and all the $Ar^1$ to $Ar^4$ are the same is excluded.

(2)

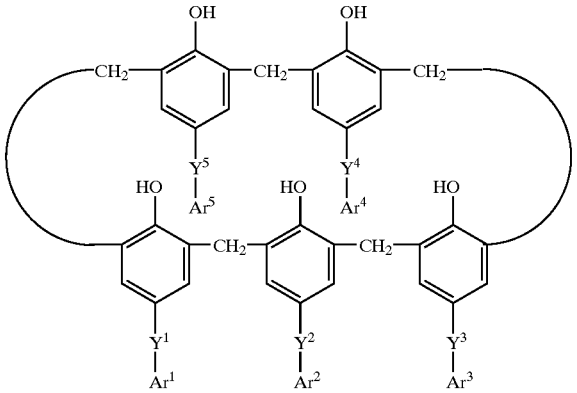

In the formula (2), $Y^1$ to $Y^5$ each independently represent —CH═N—, —CH═CH—, —N═N— or —N(O)═N—, and $Ar^1$ to $Ar^5$ each independently represent a substituted or unsubstituted aromatic hydrocarbon ring or a substituted or unsubstituted aromatic heterocyclic ring, provided that a case in which all the $Y^1$ to $Y^5$ are —N═N— and all the $Ar^1$ to $Ar^5$ are the same is excluded.

(3)

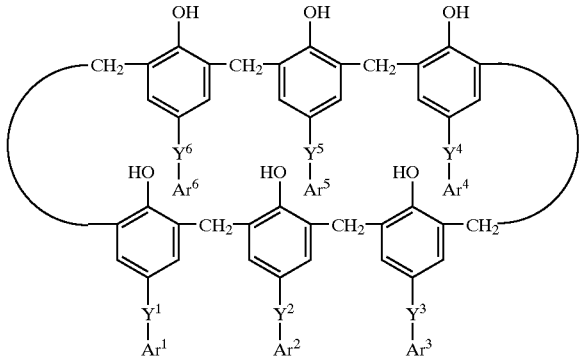

In the formula (3), $Y^1$ to $Y^6$ each independently represent —CH═N—, —CH═CH—, —N═N— or —N(O)═N—, and $Ar^1$ to $Ar^6$ each independently represent a substituted or unsubstituted aromatic hydrocarbon ring or a substituted or unsubstituted aromatic heterocyclic ring, provided that a case in which all the $Y^1$ to $Y^6$ are —N═N— and all the $Ar^1$ to $Ar^6$ are the same is excluded.

(4)

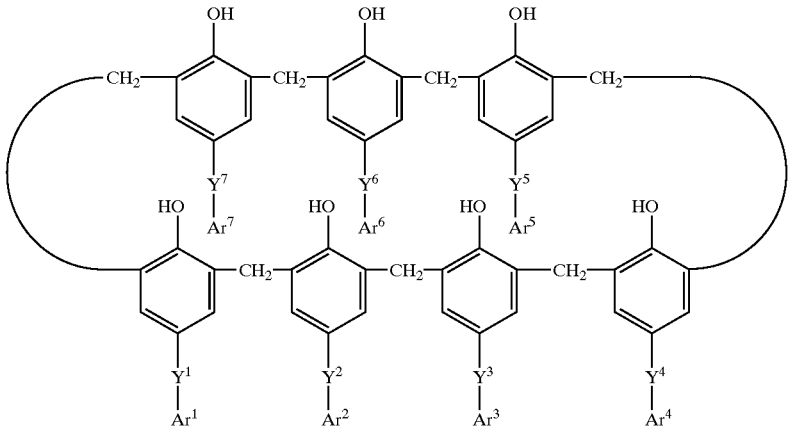

In the formula (4), $Y^1$ to $Y^7$ each independently represent —CH═N—, —CH═CH—, —N═N— or —N(O)═N—, and $Ar^1$ to $Ar^7$ each independently represent a substituted or unsubstituted aromatic hydrocarbon ring or a substituted or unsubstituted aromatic heterocyclic ring, provided that a case in which all the $Y^1$ to $Y^7$ are —N═N— and all the $Ar^1$ to $Ar^7$ are the same is excluded.

(5)

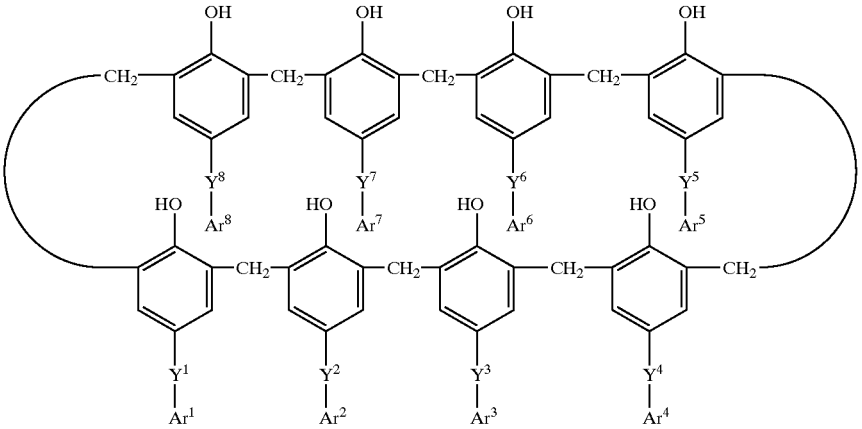

In the formula (5), $Y^1$ to $Y^8$ each independently represent —CH═N—, —CH═CH—, —N═N— or —N(O)═N—, and $Ar^1$ to $Ar^8$ each independently represent a substituted or unsubstituted aromatic hydrocarbon ring or a substituted or unsubstituted aromatic heterocyclic ring, provided that a case in which all the $Y^1$ to $Y^8$ are —N═N— and all the $Ar^1$ to $Ar^8$ are the same is excluded.

The aromatic hydrocarbon ring may include benzene, naphthalene, fluorene, phenanthrene, anthracene, fluoranthene and pyrene. The aromatic heterocyclic ring may include furan, thiophene, pyridine, indole, benzothiazole, carbazole, benzocarbazole, acridone, dibenzothiophene, benzoxazole, benzotriazole, oxathiazole, thiazole, phenazine, cinnoline and benzocinnoline.

The substituent the aromatic hydrocarbon ring or aromatic heterocyclic ring may have may include alkyl groups such as methyl, ethyl, propyl and butyl, alkoxyl groups such as methoxyl and ethoxyl, dialkylamino groups such as dimethylamino and diethylamino, alkoxycarbonyl groups such as methoxycarbonyl and ethoxycarbonyl, halogen atoms such as a fluorine atom, a chlorine atom and a bromine atom, and also a hydroxyl group, a nitro group, a cyano group and a halomethyl group.

It is also preferable that at least one of the Ar's (which refer to $Ar^1$ to $Ar^4$ in the case of the formula (1), $Ar^1$ to $Ar^5$ in the case of the formula (2), $Ar^1$ to $Ar^6$ in the case of the formula (3), $Ar^1$ to $Ar^7$ in the case of the formula (4), and $Ar^1$ to $Ar^8$ in the case of the formula (5); the same applies hereinafter) is a phenyl group having an electron-attracting group. It is more preferable that all the Ar's are phenyl groups each having an electron-attracting group.

Such an electron-attracting group may preferably be any of a cyano group, a nitro group and a halogen atom.

It is still also preferable that at least one of the Ar's is a phenyl group having a nitro group or a cyano group at the meta-position in respect to the position at which it is bonded to any of the Y's (which refer to $Y^1$ to $Y^4$ in the case of the formula (1), $Y^1$ to $Y^5$ in the case of the formula (2), $Y^1$ to $Y^6$ in the case of the formula (3), $Y^1$ to $Y^7$ in the case of the formula (4), and $Y^1$ to $Y^8$ in the case of the formula (5); the same applies hereinafter). It is more preferable that all the Ar's are phenyl groups each having a nitro group or a cyano group at the meta-position.

It is also preferable that all the Y's are —N═N—, and the Ar's are substituted or unsubstituted phenyl groups of two or more types.

The carixarene compound having the structure represented by the formula (1) is preferred because especially high image quality can be achieved and a solution or dispersion of the carixarene compound (e.g., a dispersion for the charge generation layer) can have good dispersed state and stability.

Preferred specific examples of the carixarene compound used in the photosensitive layer of the electrophotographic photosensitive member according to the present invention are shown below, to which, however, the present invention is by no means limited.

In Tables 1 to 8, it means that Y is bonded to the carixarene through its bonding arm on the left side, and to the Ar through its bonding arm on the right side.

In the azoxy group (—N(O)═N—), the oxygen atom may be coordinated to either nitrogen atom, and also it can not be ascertained which it is.

First, preferred specific examples of the carixarene compound having the structure represented by the formula (1) are shown in Tables 1 to 4.

TABLE 1

| | Exemplary Compound | | | |
|---|---|---|---|---|
| | (1) | (2) | (3) | (4) |
| $Y^1$-$Y^4$: | —N═N— | —N═N— | —N═N— | —N═N— |
| $Ar^1$: | 3,5-dinitrophenyl group | 3,5-dinitrophenyl group | 3,5-dinitrophenyl group | 3,5-dinitrophenyl group |
| $Ar^2$: | 3,5-dinitrophenyl group | 3-nitrophenyl group | 3-nitrophenyl group | 3,5-dinitrophenyl group |
| $Ar^3$: | 3,5-dinitrophenyl group | 3,5-dinitrophenyl group | 3-nitrophenyl group | 3-nitrophenyl group |

TABLE 1-continued

| | Exemplary Compound | | | |
|---|---|---|---|---|
| | (1) | (2) | (3) | (4) |
| $Ar^4$: | 3-nitrophenyl group | 3-nitrophenyl group | 3-nitrophenyl group | 3-nitrophenyl group |

TABLE 2

| | Exemplary Compound | | | |
|---|---|---|---|---|
| | (5) | (6) | (7) | (8) |
| $Y^1$-$Y^4$: | —N═N— | —N═N— | —N═N— | —N═N— |
| $Ar^1$: | 3,5-dinitrophenyl group | 3,5-dinitrophenyl group | 3-nitrophenyl group | 3,5-dinitrophenyl group |
| $Ar^2$: | 3,5-dinitrophenyl group | 3,5-dinitrophenyl group | 3-nitrophenyl group | 3,5-dinitrophenyl group |
| $Ar^3$: | 3,5-dinitrophenyl group | 3,5-dinitrophenyl group | 3-nitrophenyl group | 3,5-dinitrophenyl group |
| $Ar^4$: | 3-pyridyl group | 3-chlorophenyl group | 3-cyanophenyl group | 3-cyanophenyl group |

TABLE 3

| | Exemplary Compound | | | |
|---|---|---|---|---|
| | (9) | (10) | (11) | (12) |
| $Y^1$-$Y^4$: | —CH═N— | —N═CH— | —CH═CH— | —CH═CH— |
| $Ar^1$: | 3,5-dinitrophenyl group | 3,5-dinitrophenyl group | 3-nitrophenyl group | 3,5-dinitrophenyl group |
| $Ar^2$: | 3,5-dinitrophenyl group | 3,5-dinitrophenyl group | 3-nitrophenyl group | 3,5-dinitrophenyl group |
| $Ar^3$: | 3,5-dinitrophenyl group | 3,5-dinitrophenyl group | 3-nitrophenyl group | 3,5-dinitrophenyl group |
| $Ar^4$: | 3,5-dinitrophenyl group | 3-nitrophenyl group | 3-nitrophenyl group | 3-cyanophenyl group |

TABLE 4

| | Exemplary Compound | | | |
|---|---|---|---|---|
| | (13) | (14) | (15) | (16) |
| $Y^1$: | —N(O)═N— | —N(O)═N— | —N(O)═N— | —N═(O)N— |
| $Y^2$: | —N(O)═N— | —N(O)═N— | —N═N— | —N═N— |
| $Y^3$: | —N(O)═N— | —N(O)═N— | —N(O)═N— | —N═N— |
| $Y^4$: | —N(O)═N— | —N(O)═N— | —N═N— | —N═N— |
| $Ar^1$: | 3,5-dinitrophenyl group | 3,5-dinitrophenyl group | 3-nitrophenyl group | 3,5-dinitrophenyl group |
| $Ar^2$: | 3,5-dinitrophenyl group | 3,5-dinitrophenyl group | 3-nitrophenyl group | 3,5-dinitrophenyl group |
| $Ar^3$: | 3,5-dinitrophenyl group | 3,5-dinitrophenyl group | 3-nitrophenyl group | 3,5-dinitrophenyl group |

TABLE 4-continued

| | Exemplary Compound | | | |
|---|---|---|---|---|
| | (13) | (14) | (15) | (16) |
| $Ar^4$: | 3-cyanophenyl group | 3-nitrophenyl group | 3-nitrophenyl group | 3,5-dinitrophenyl group |

Next, preferred specific examples of the carixarene compound having the structure represented by the formula (3) are shown in Table 5.

TABLE 5

| | Exemplary Compound | | | |
|---|---|---|---|---|
| | (17) | (18) | (19) | (20) |
| $Y^1$: | —N═N— | —N═N— | —N═N— | —N═N— |
| $Y^2$: | —N═N— | —N═N— | —N═N— | —N═N— |
| $Y^3$: | —N═N— | —N═N— | —N═N— | —N═N— |
| $Y^4$: | —N═N— | —N═N— | —N═N— | —N═N— |
| $Y^5$: | —N═N— | —N═N— | —N═N— | —N═N— |
| $Y^6$: | —N═N— | —N═N— | —N═N— | —N(O)═N— |
| $Ar^1$: | 3,5-dinitrophenyl group | 3,5-dinitrophenyl group | 3,5-dinitrophenyl group | 3-nitrophenyl group |
| $Ar^2$: | 3,5-dinitrophenyl group | 3-chlorophenyl group | 3-nitrophenyl group | 3-nitrophenyl group |
| $Ar^3$: | 3,5-dinitrophenyl group | 3,5-dinitrophenyl group | 3-nitrophenyl group | 3-nitrophenyl group |
| $Ar^4$: | 3-pyridyl group | 3-chlorophenyl group | 3,5-dinitrophenyl group | 3-nitrophenyl group |
| $Ar^5$: | 3,5-dinitrophenyl group | 3,5-dinitrophenyl group | 3-nitrophenyl group | 3-nitrophenyl group |
| $Ar^6$: | 3,5-dinitrophenyl group | 3-chlorophenyl group | 3-nitrophenyl group | 3-nitrophenyl group |

Next, preferred specific examples of the carixarene compound having the structure represented by the formula (5) are shown in Table 6.

TABLE 6

| | Exemplary Compound | | | |
|---|---|---|---|---|
| | (21) | (22) | (23) | (24) |
| $Y^1$: | —N(O)═N— | —N═N— | —N═CH— | —N═N— |
| $Y^2$: | —N(O)═N— | —N═N— | —N═CH— | —N═N— |
| $Y^3$: | —N(O)═N— | —N═N— | —N═CH— | —N═N— |
| $Y^4$: | —N(O)═N— | —N═N— | —N═CH— | —N═N— |
| $Y^5$: | —N(O)═N— | —N═N— | —N═CH— | —N═N— |
| $Y^6$: | —N(O)═N— | —N═N— | —N═CH— | —N═N— |
| $Y^7$: | —N(O)═N— | —N═N— | —N═CH— | —N═N— |
| $Y^8$: | —N(O)═N— | —N═N— | —N═CH— | —N(O)═N— |
| $Ar^1$: | 3,5-dinitrophenyl group | 3-cyanophenyl group | 3-nitrophenyl group | 3-nitrophenyl group |
| $Ar^2$: | 3,5-dinitrophenyl group | 3-nitrophenyl group | 3-nitrophenyl group | 3-nitrophenyl group |
| $Ar^3$: | 3,5-dinitrophenyl group | 3-nitrophenyl group | 3-nitrophenyl group | 3-nitrophenyl group |
| $Ar^4$: | 3,5-dinitrophenyl group | 3-nitrophenyl group | 3-nitrophenyl group | 3-nitrophenyl group |
| $Ar^5$: | 3,5-dinitrophenyl group | 3-cyanophenyl group | 3-nitrophenyl group | 3-nitrophenyl group |
| $Ar^6$: | 3,5-dinitrophenyl group | 3-nitrophenyl group | 3-nitrophenyl group | 3-nitrophenyl group |
| $Ar^7$: | 3,5-dinitrophenyl group | 3-nitrophenyl group | 3-nitrophenyl group | 3-nitrophenyl group |
| $Ar^8$: | 3,5-dinitrophenyl group | 3-nitrophenyl group | 3-nitrophenyl group | 3-nitrophenyl group |

Next, preferred specific examples of the carixarene compound having the structure represented by the formula (2) are shown in Table 7.

TABLE 7

| | Exemplary Compound | |
|---|---|---|
| | (25) | (26) |
| $Y^1$: | —N═N— | —N═N— |
| $Y^2$: | —N═N— | —N═N— |
| $Y^3$: | —N═N— | —N═N— |
| $Y^4$: | —N═N— | —N═N— |
| $Y^5$: | —N═N— | —N(O)═N— |
| $Ar^1$: | 3,5-dinitrophenyl group | 3-nitrophenyl group |
| $Ar^2$: | 3-nitrophenyl group | 3-nitrophenyl group |
| $Ar^3$: | 3-nitrophenyl group | 3-nitrophenyl group |
| $Ar^4$: | 3,5-dinitrophenyl group | 3-nitrophenyl group |
| $Ar^5$: | 3-nitrophenyl group | 3-nitrophenyl group |

Next, preferred specific examples of the carixarene compound having the structure represented by the formula (4) are shown in Table 8.

TABLE 8

| | Exemplary Compound | |
|---|---|---|
| | (27) | (28) |
| $Y^1$: | —N═CH— | —N═N— |
| $Y^2$: | —N═CH— | —N═N— |
| $Y^3$: | —N═CH— | —N═N— |
| $Y^4$: | —N═CH— | —N═N— |
| $Y^5$: | —N═CH— | —N═N— |
| $Y^6$: | —N═CH— | —N═N— |
| $Y^7$: | —N═CH— | —N(O)═N— |
| $Ar^1$: | 3-nitrophenyl group | 3-nitrophenyl group |
| $Ar^2$: | 3-nitrophenyl group | 3-nitrophenyl group |
| $Ar^3$: | 3-nitrophenyl group | 3-nitrophenyl group |
| $Ar^4$: | 3-nitrophenyl group | 3-nitrophenyl group |
| $Ar^5$: | 3-nitrophenyl group | 3-nitrophenyl group |
| $Ar^6$: | 3-nitrophenyl group | 3-nitrophenyl group |
| $Ar^7$: | 3-nitrophenyl group | 3-nitrophenyl group |

Of these, Exemplary Compounds (1) to (8) and (15) to (20) are preferred. Exemplary Compounds (1) to (4), (7), (8), (16) and (19) are particularly preferred. Still more preferred are Exemplary Compounds (1) and (2), i.e., a carixarene compound having structure represented by the following formula (6) and a carixarene compound having structure represented by the following formula (7).

(6)

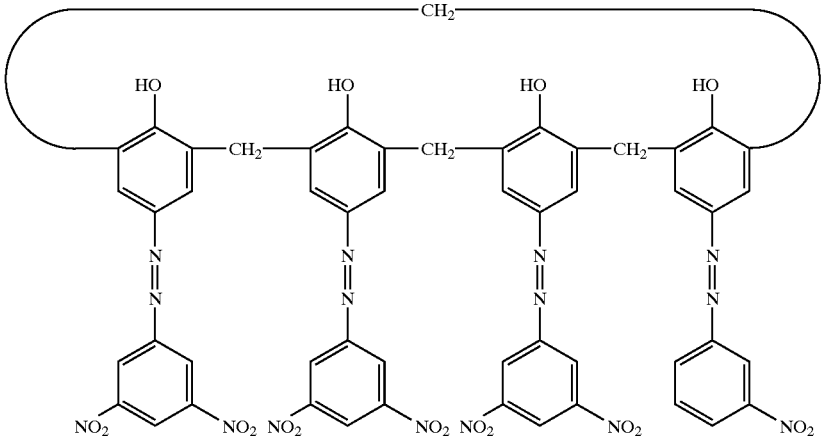

(7)

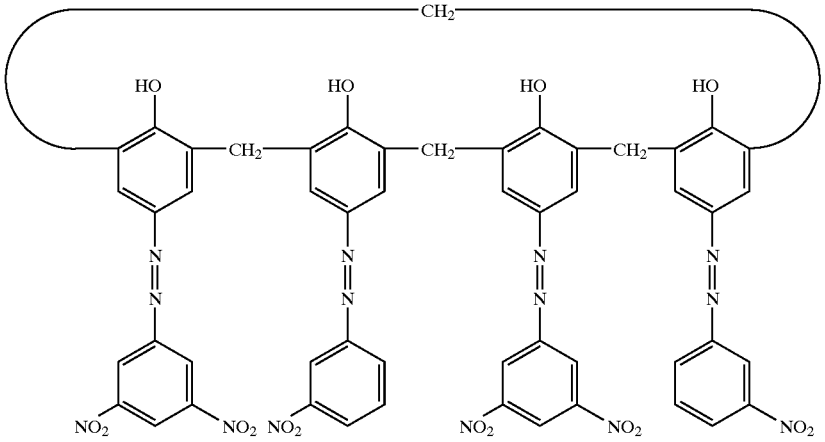

A method of synthesizing the carixarene compound having the structure represented by any one formula selected from the group consisting of the above formulas (1) to (5) is shown below.

In the case when Y is —CH═N— or —N(O)═N—, it may be synthesized according to Japanese Patent Application Laid-open No. 5-271175, and, in the case when Y is —CH═CH—, according to J. Org. Chem., Vol. 66, No. 19 (2001), pp. 6432–6439. Also, in the case when Y is —N═N—, mono-, di- and tri-substituted products may be synthesized according to J. Org. Chem., Vol. 59, No. 4 (1994), pp. 754–757 and thereafter the azonium salt may be changed, followed by coupling again to synthesize the carixarene compound having the structure represented by any one formula selected from the group consisting of the above formulas (1) to (5).

SYNTHESIS EXAMPLE

Synthesis of Exemplary Compound (1)

In an atmosphere of nitrogen, 2.5 parts (by weight; the same applies hereinafter) of carix[4]arene, 80 parts of tetrahydrofuran and 20 parts of pyridine are put into a three-necked flask, and these were cooled to −15° C. Thereafter, keeping this temperature, 4.5 parts of a borofluoride having structure represented by the following formula:

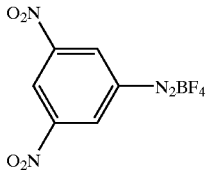

was slowly added over a period of 3 hours. At the temperature as it was, the mixture formed was stirred for 30 minutes, and thereafter a precipitate was collected by filtration, followed by washing with chloroform, acetone and then tetrahydrofuran. The yellowish red compound thus obtained was returned to the three-necked flask in an atmosphere of nitrogen, to which 200 parts of tetrahydrofuran was further added. The resultant mixture formed was cooled to 0° C., and 1.4 parts of a borofluoride having structure represented by the following formula:

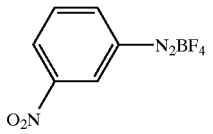

was added thereto, followed by further slow addition of 10 parts of pyridine. The resultant reaction mixture was heated to 60° C., and then stirred for 3 hours, followed by filtration. The filtrate obtained was thoroughly washed with tetrahydrofuran, an aqueous 5% hydrochloric acid and acetone, followed by drying at room temperature under reduced pressure to obtain 3.2 parts of a yellow, exemplary compound (1) (a carixarene compound having structure represented by the above formula (6)).

Mass Spectrometric Analysis Spectrum m/z: 1,154.2 (M−1)

Mass spectrum measuring instrument:

Manufacturer: BRUKER

Model: REFLEX III-TOF

Measurement mode: NEGA

The photosensitive layer of the electrophotographic photosensitive member according to the present invention may preferably contain, in addition to the carixarene compound having the structure represented by any one formula selected from the group consisting of the above formulas (1) to (5), a phthalocyanine pigment or an azo pigment as a charge-generating material. In particular, a phthalocyanine pigment is more preferred.

As the azo pigment, any azo pigment may be used, such as bisazo, trisazo and tetrakisazo pigments. In particular, benzanthrone azo pigments disclosed in Japanese Patent Application Laid-open Nos. 59-31962 and 1-183663 have superior sensitivity characteristics but on the other hand tend to cause ghost, and hence are preferable because the present invention acts effectively.

As the phthalocyanine pigment, any phthalocyanine pigment may be used, such as metal-free phthalocyanine and metal phthalocyanines which may have an axial ligand. These may each have a substituent. In particular, an oxytitanium phthalocyanine and a gallium phthalocyanine have superior sensitivity characteristics but on the other hand tend to cause ghost, and hence are preferable because the present invention acts effectively.

The phthalocyanine pigment may have any crystal form. In particular, a hydroxygallium phthalocyanine with a crystal form having strong peaks at 7.4°±0.2° and 28.2°±0.2° of the Bragg's angle 2θ in CuKα characteristic X-ray diffraction, a chlorogallium phthalocyanine with a crystal form having strong peaks at 7.4°, 16.6°, 25.5° and 28.3° of the Bragg's angle 2θ±0.2° in CuKα characteristic X-ray diffraction and an oxytitanium phthalocyanine with a crystal form having a strong peak at 27.2±0.2° of the Bragg's angle 2θ in CuKα characteristic X-ray diffraction have superior sensitivity characteristics but on the other hand tend to cause ghost, and hence are preferable because the present invention acts effectively.

In particular, the hydroxygallium phthalocyanine with a crystal form having strong peaks at 7.40±0.2° and 28.2°±0.2° of the Bragg's angle 2θ in CuKα characteristic X-ray diffraction and the oxytitanium phthalocyanine with a crystal form having a strong peak at 27.2±0.2° of the Bragg's angle 2θ in CuKα characteristic X-ray diffraction are preferred.

Further in particular, a hydroxygallium phthalocyanine with a crystal form having strong peaks at 7.3°, 24.9° and 28.1° of the Bragg's angle 2θ±0.2° in CuKα characteristic X-ray diffraction, a hydroxygallium phthalocyanine with a crystal form having strong peaks at 7.5°, 9.9°, 16.3°, 18.6°, 25.1° and 28.3° of the Bragg's angle 2θ±0.2° in CuKα characteristic X-ray diffraction, an oxytitanium phthalocyanine with a crystal form having strong peaks at 9.0°, 14.2°, 23.9° and 27.1° of the Bragg's angle 2θ±0.2° in CuKα characteristic X-ray diffraction and an oxytitanium phthalocyanine with a crystal form having strong peaks at 9.5°, 9.7°, 11.7°, 15.0°, 23.5°, 24.1° and 27.3° of the Bragg's angle 2θ±0.2° in CuKα characteristic X-ray diffraction are preferred.

The photosensitive layer formed on a support of the electrophotographic photosensitive member according to the present invention is roughly conceptionally classified into a single-layer photosensitive layer containing the carixarene compound having the structure represented by any one formula selected from the group consisting of the above formulas (1) to (5), a charge-generating material and a charge-transporting material in a single layer, and a multilayer photosensitive layer formed superposingly of a charge generation layer containing the carixarene compound having the structure represented by any one formula selected from the group consisting of the above formulas (1) to (5) and a charge-generating material and a charge transport layer containing a charge-transporting material. The multi-layer photosensitive layer is preferred. Also, the relation of superposing the charge generation layer and the charge transport layer may be in either order. It is preferable that the charge generation layer is the lower layer.

The support may be any of those having a conductivity and may include metals such as aluminum and stainless steel, and metals, plastics or papers provided with conductive layers. The support may be in the form of a cylinder or a film.

An intermediate layer having a barrier function and an adhesion function may be provided between the support and the photosensitive layer. Materials for the intermediate layer may include polyvinyl alcohol, polyethylene oxide, ethyl cellulose, methyl cellulose, casein, polyamide, glue and gelatin. These may each be dissolved in a suitable solvent, followed by coating on the support.

The intermediate layer may preferably be in a layer thickness of from 0.2 μm to 3.0 μm.

Between the support and the intermediate layer, a conductive layer may also be provided so that any unevenness or defects on the support can be covered and interference fringes can be prevented. The conductive layer may be formed using a coating dispersion prepared by dispersing a conductive powder such as carbon black, metal particles or metal oxide in the binder resin.

The conductive layer may preferably be in a layer thickness of from 5 μm to 40 μm, and particularly preferably from 10 μm to 30 μm.

Where the single-layer photosensitive layer is formed, the carixarene compound having the structure represented by any one formula selected from the group consisting of the above formulas (1) to (5), a charge-generating material and a charge-transporting material may be mixed in a suitable binder resin solution, and the mixture thus obtained may be coated on the support, followed by drying.

Where the multi-layer photosensitive layer is formed, to form the charge generation layer, the carixarene compound having the structure represented by any one formula selected from the group consisting of the above formulas (1) to (5) and a charge-generating material may be dispersed in a suitable binder resin solution, and the dispersion thus obtained may be coated on the support, followed by drying. To form the charge-transporting material, a coating solution prepared by dissolving a charge-transporting material and a binder resin in a solvent may be coated on the support, followed by drying.

The charge-transporting material may include triarylamine compounds, hydrazone compounds, stilbene compounds, pyrazoline compounds, oxazole compounds, thiazole compounds and triallylmethane compounds. As charge-generating materials used in combination with the carixarene compound having the structure represented by any one formula selected from the group consisting of the above formulas (1) to (5), triarylamine compounds are preferred.

As the binder resin used to form the respective layers, usable are, e.g., resins such as polyester, acrylic resins, polyvinyl carbazole, phenoxy resins, polycarbonate, polyvinyl butyral, polystyrene, polyvinyl acetate, polysulfone, polyarylate, vinylidene chloride, acrylonitrile copolymers and polyvinyl benzal. As the binder resin in which the carixarene compound having the structure represented by any one formula selected from the group consisting of the above formulas (1) to (5) is to be dispersed, polyvinyl butyral and polyvinyl benzal are preferred.

These layers may be coated by a coating method such as dip coating, spray coating, spinner coating, bead coating, blade coating and beam coating.

Where the photosensitive layer is of the single layer type, it may preferably be in a layer thickness of from 5 μm to 40 μm, and particularly preferably from 10 μm to 30 μm.

Where the photosensitive layer is of the multi-layer type, the charge generation layer may preferably be in a layer thickness of from 0.01 μm to 10 μm, and particularly preferably from 0.05 μm to 5 μm. The charge transport layer may preferably be in a layer thickness of from 5 μm to 40 μm, and particularly preferably from 10 μm to 30 μm.

Where the photosensitive layer is of the single layer type, the carixarene compound having the structure represented by any one formula selected from the group consisting of the above formulas (1) to (5) may preferably be in a content of from 0.00001 to 1% by weight based on the total weight of the photosensitive layer. The charge-generating material may preferably be in a content of from 3 to 30% by weight based on the total weight of the photosensitive layer. The charge-transporting material may preferably be in a content of from 30 to 70% by weight based on the total weight of the photosensitive layer.

Where the photosensitive layer is of the multi-layer type, the carixarene compound having the structure represented by any one formula selected from the group consisting of the above formulas (1) to (5) may preferably be in a content of from 0.0001 to 20% by weight, and particularly preferably from 0.001 to 10% by weight, based on the total weight of the charge generation layer. The charge-generating material may preferably be in a content of from 30 to 90% by weight, and particularly preferably from 50 to 80% by weight, based on the total weight of the charge generation layer. The charge-transporting material may preferably be in a content of from 20 to 80% by weight, and particularly preferably from 30 to 70% by weight, based on the total weight of the charge transport layer.

In any cases, the carixarene compound having the structure represented by any one formula selected from the group consisting of the above formulas (1) to (5) may preferably be in a content of from 0.1 to 10% by weight, and particularly preferably from 0.2 to 5% by weight, based on the weight of the charge-generating material.

On the photosensitive layer, a protective layer may be provided for the purpose of protecting the photosensitive layer. To form the protective layer, a coating solution prepared by dissolving in a suitable organic solvent a resin such as polyvinyl butyral, polyester, polycarbonate (polycarbonate Z or modified polycarbonate), nylon, polyimide, polyarylate, polyurethane, a styrene-butadiene copolymer, a styrene-acrylic acid copolymer or a styrene-acrylonitrile copolymer may be coated on the photosensitive layer, followed by drying, or may be coated on the photosensitive layer, followed by curing by heat, electron rays, ultraviolet rays or the like. The protective layer may preferably be in a layer thickness of from 0.05 μm to 20 μm.

The protective layer may also be incorporated therein with conductive particles, an ultraviolet absorber and lubricating particles such as fluorine-containing fine resin particles. As the conductive particles, metal oxide particles as exemplified by tin oxide particles are preferable.

In any embodiments of the electrophotographic photosensitive member of the present invention, the crystal form of the carixarene compound used, having the structure represented by any one formula selected from the group consisting of the above formulas (1) to (5), may be amorphous or may be crystalline. Also, the carixarene compound may optionally be used in combination of two or more types.

The electrophotographic apparatus and the process cartridge which have the electrophotographic photosensitive member of the present invention are described below.

In FIG. 1, reference numeral 1 denotes a drum type electrophotographic photosensitive member of the present invention, which is rotatingly driven around an axis 1*a* in the direction of an arrow at a given peripheral speed. In the course of its rotation, the electrophotographic photosensitive member 1 is uniformly electrostatically charged on its periphery to a positive or negative, given potential through a primary charging means 2. The electrophotographic photosensitive member thus charged is then exposed to light L emitted from an exposure means (not shown; slit exposure or laser beam scanning exposure). In this way, electrostatic latent images corresponding to exposure images are successively formed on the periphery of the electrophotographic photosensitive member 1.

The electrostatic latent images thus formed are subsequently developed with toner by a developing means 4. The resulting toner-developed images are then successively transferred by a (corona) transfer means 5, to the surface of a transfer material 9 fed from a paper feed section (not shown) to the part between the electrophotographic photosensitive member 1 and the transfer means 5 in the manner synchronized with the rotation of the electrophotographic photosensitive member 1.

The transfer material 9 to which the images have been transferred is separated from the surface of the electrophotographic photosensitive member, is led to a fixing means 8, where the images are fixed, and is then delivered out of the apparatus as a copied material (a copy).

The surface of the electrophotographic photosensitive member 1 after the transfer of images is brought to removal of the toner remaining after the transfer, through a cleaning means 6. Thus, the electrophotographic photosensitive member is cleaned on its surface, further subjected to charge elimination by a pre-exposure means (not shown), and then repeatedly used for the formation of images.

Figure 2:
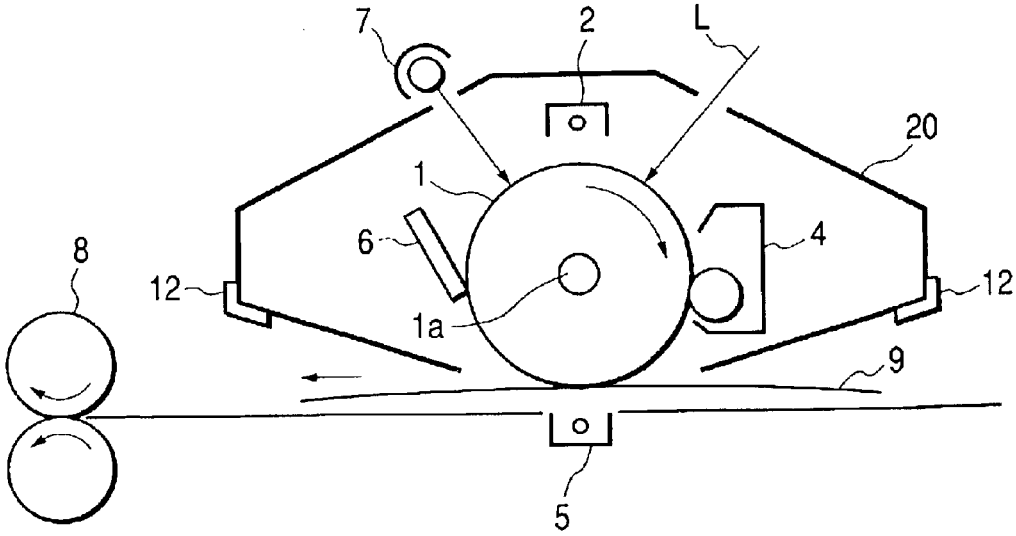
FIG. 2 is a schematic view showing an example of the construction of an electrophotographic apparatus provided with a process cartridge having the electrophotographic photosensitive member of the present invention.

In the apparatus shown in FIG. 2, at least the electrophotographic photosensitive member 1, the charging means 2 and the developing means 4 are received in a container 20 to make up a process cartridge. The process cartridge is so constructed as to be detachably mountable to the main body of the apparatus by the use of a guide means 12 such as rails.

Figure 3:
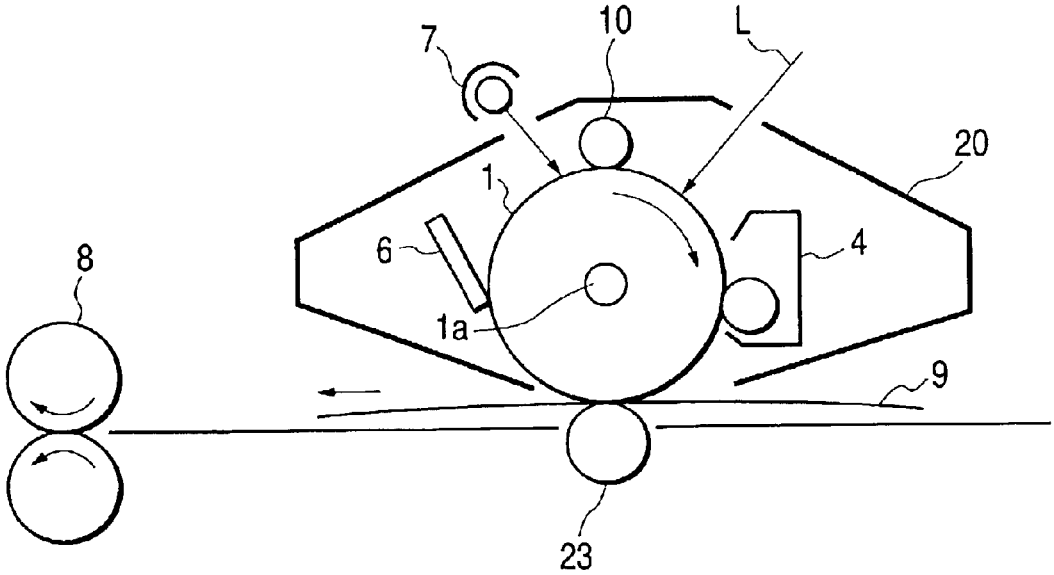
FIG. 3 is a schematic view showing another example of the construction of an electrophotographic apparatus provided with a process cartridge having the electrophotographic photosensitive member of the present invention.
Figure 4:
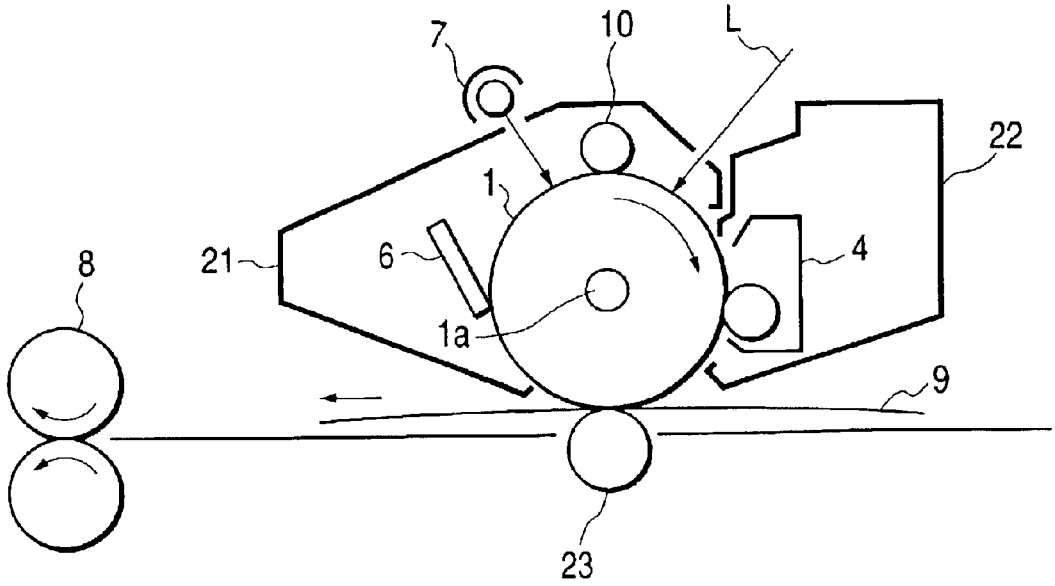
FIG. 4 is a schematic view showing still another example of the construction of an electrophotographic apparatus provided with a process cartridge having the electrophotographic photosensitive member of the present invention.

As also shown in FIGS. 3 and 4, a contact charging means 10 may be employed as the charging means, and the contact charging means 10, to which a voltage is kept applied, may be brought into contact with the electrophotographic photosensitive member 1 to charge the electrophotographic photosensitive member electrostatically (hereinafter, this charging system is called contact charging).

In the apparatus shown in FIGS. 3 and 4, the toner image held on the electrophotographic photosensitive member 1 is transferred also by a contact transfer means 23 to a transfer material 9. More specifically, the contact transfer means 23, to which a voltage is kept applied, is brought into contact with the transfer material 9 to transfer to the transfer material 9 the toner image held on the electrophotographic photosensitive member 1.

In addition, in the apparatus shown in FIG. 4, at least the electrophotographic photosensitive member 1 and the contact charging means 10 are received in a first container 21 to make up a first process cartridge, and at least the developing means 4 is received in a second container 22 to make up a second process cartridge. These first process cartridge and second process cartridge are so constructed as to be detachably mountable to the main body of the apparatus.

The cleaning means 6 need not necessarily be provided. Also, where the charging means 2 is a contact charging means, the pre-exposure means 7 need not necessarily be provided.

The present invention is described below in greater detail by giving Examples. In the following Examples, "part(s)" refers to "part(s) by weight".

Example 1

50 parts of titanium oxide powder coated with tin oxide, containing 10% of antimony oxide, 25 parts of resol type phenol resin, 20 parts of methyl cellosolve, 5 parts of methanol and 0.002 part of silicone oil (polydimethylsiloxane-polyoxyalkylene copolymer; average molecular weight: 3,000) were dispersed for 2 hours by means of a sand mill making use of glass beads of 1 mm diameter to prepare a conductive coating dispersion. This coating dispersion was dip-coated on an aluminum cylinder (30 mm diameter×260.5 mm length) as a support, followed by drying at 140° C. for 30 minutes to form a conductive layer with a layer thickness of 20 $\mu$m.

On this conductive layer, a solution prepared by dissolving 5 parts of a 6-66-610-12 polyamide quadripolymer in a mixed solvent of 70 parts of methanol and 25 parts of butanol was dip-coated, followed by drying to form an intermediate layer with a layer thickness of 1 $\mu$m.

Next, 10 parts of hydroxygallium phthalocyanine with a crystal form having strong peaks at 7.5°, 9.9°, 16.3°, 18.6°, 25.1° and 28.3° of the Bragg's angle 2θ±0.2° in CuKα characteristic X-ray diffraction, 0.1 part of the exemplary compound (1) and 5 parts of polyvinyl butyral resin (trade name: S-LEC BX-1; available from Sekisui Chemical Co., Ltd.) were added to 250 parts of cyclohexanone. The mixture obtained was dispersed for 1 hour by means of a sand mill making use of glass beads of 1 mm diameter. To the dispersion thus obtained, 250 parts of ethyl acetate was added to dilute it. Thereafter, the resultant dispersion was coated on the intermediate layer, followed by drying at 100° C. for 10 minutes to form a charge generation layer with a layer thickness of 0.16 $\mu$m.

Next, 10 parts of a charge-transporting material having structure represented by the following formula:

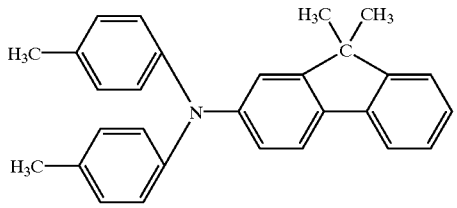

and 10 parts of polycarbonate resin (trade name: EUPILON Z-200; available from Mitsubishi Gas Chemical Company, Inc.) were dissolved in 70 parts of monochlorobenzene to make up a solution, which was then coated on the charge generation layer by dipping, followed by drying at 110° C. for 1 hour to form a charge transport layer with a layer thickness of 25 $\mu$m. Thus, a drum-shaped electrophotographic photosensitive member of Example 1 was obtained.

Example 2

An electrophotographic photosensitive member of Example 2 was produced in the same manner as in Example 1 except that the exemplary compound (1) used therein was added in an amount changed to 0.02 part.

Example 3

An electrophotographic photosensitive member of Example 3 was produced in the same manner as in Example 1 except that the exemplary compound (1) used therein was added in an amount changed to 0.5 parts.

Example 4

An electrophotographic photosensitive member of Example 4 was produced in the same manner as in Example 1 except that the exemplary compound (1) used therein was changed to combination of 0.1 part of the exemplary compound (2) and 0.1 part of the exemplary compound (3).

Example 5

An electrophotographic photosensitive member of Example 5 was produced in the same manner as in Example 1 except that the exemplary compound (1) used therein was changed to the exemplary compound (16).

Example 6

An electrophotographic photosensitive member of Example 6 was produced in the same manner as in Example 1 except that the exemplary compound (1) used therein was changed to the exemplary compound (19).

Example 7

An electrophotographic photosensitive member of Example 7 was produced in the same manner as in Example 1 except that the hydroxygallium phthalocyanine with a crystal form having strong peaks at 7.5°, 9.9°, 16.3°, 18.6°, 25.1° and 28.3° of the Bragg's angle 2θ±0.2° in CuKα characteristic X-ray diffraction used therein was changed to oxytitanium phthalocyanine with a crystal form having strong peaks at 9.0°, 14.2°, 23.9° and 27.1° of the Bragg's angle 2θ±0.2° in CuKα characteristic X-ray diffraction.

Example 8

Layers up to the charge generation layer were formed in the same manner as in Example 1.

Next, 10 parts of a charge-transporting material having structure represented by the following formula:

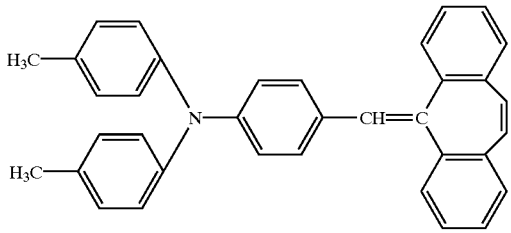

and 10 parts of polycarbonate resin (trade name: EUPILON Z-400; available from Mitsubishi Gas Chemical Company, Inc.) were dissolved in 100 parts of monochlorobenzene to make up a solution, which was then coated on the charge generation layer by dipping, followed by drying at 150° C. for 30 minutes to form a charge transport layer with a layer thickness of 15 μm. Thus, an electrophotographic photosensitive member of Example 8 was obtained.

Example 9

Layers up to the charge generation layer were formed in the same manner as in Example 1.

Next, 7 parts of a charge-transporting material having structure represented by the following formula:

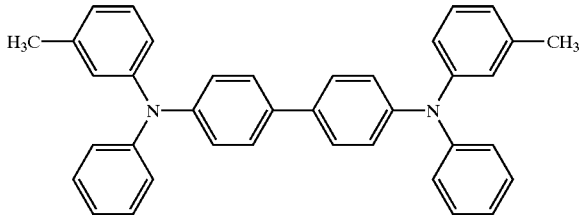

3 parts of a charge-transporting material having structure represented by the following formula:

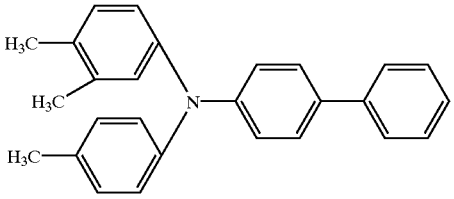

and 10 parts of polycarbonate resin (trade name: EUPILON Z-200; available from Mitsubishi Gas Chemical Company, Inc.) were dissolved in 70 parts of monochlorobenzene to make up a solution, which was then coated on the charge generation layer by dipping, followed by drying at 110° C. for 1 hour to form a charge transport layer with a layer thickness of 32 μm. Thus, an electrophotographic photosensitive member of Example 9 was obtained.

Comparative Example 1

An electrophotographic photosensitive member of Comparative Example 1 was produced in the same manner as in Example 1 except that the exemplary compound (1) used therein was not added.

Comparative Example 2

An electrophotographic photosensitive member of Comparative Example 2 was produced in the same manner as in Example 7 except that the exemplary compound (1) used therein was not added.

Comparative Example 3

An electrophotographic photosensitive member of Comparative Example 3 was produced in the same manner as in Example 7 except that 0.1 part of the exemplary compound (1) used therein was changed to 3 parts of a bisazo pigment having structure represented by the following formula:

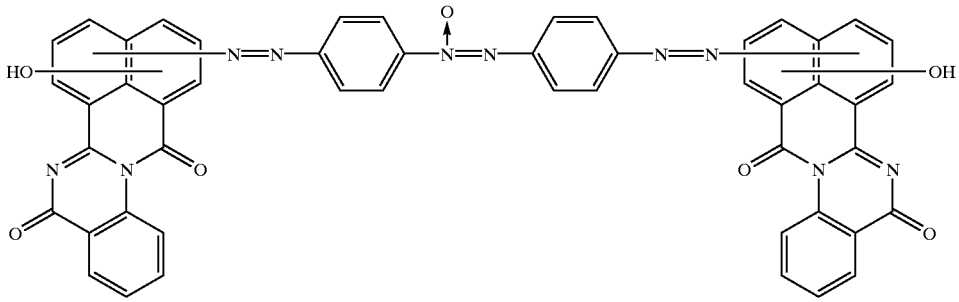

Comparative Example 4

An electrophotographic photosensitive member of Comparative Example 4 was produced in the same manner as in Example 1 except that the exemplary compound (1) used therein was changed to a carixarene compound having structure represented by the following formula:

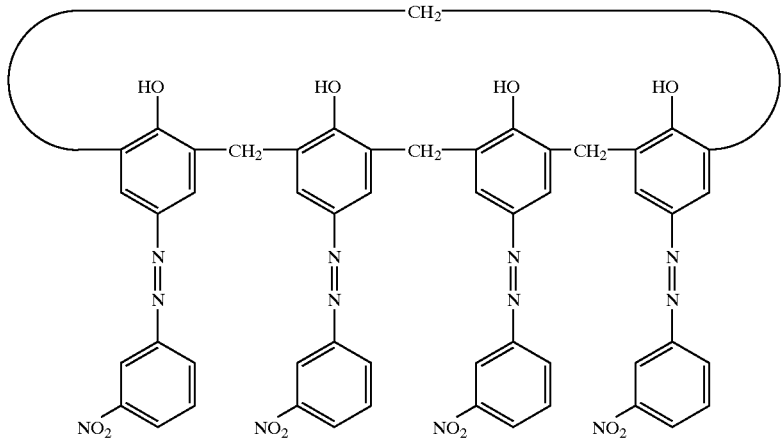

Comparative Example 5

An electrophotographic photosensitive member of Comparative Example 5 was produced in the same manner as in Example 1 except that the exemplary compound (1) used therein was changed to a carixarene compound having structure represented by the following formula:

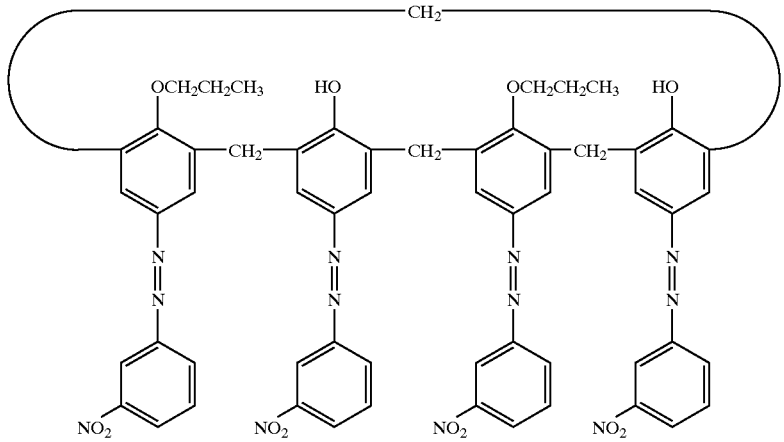

Comparative Example 6

An electrophotographic photosensitive member of Comparative Example 6 was produced in the same manner as in Comparative Example 5 except that the amount of the carixarene compound added therein was changed from 0.1 part to 0.01 part.

Comparative Example 7

An electrophotographic photosensitive member of Comparative Example 7 was produced in the same manner as in Example 1 except that the exemplary compound (1) used therein was changed to a carixarene compound having structure represented by the following formula:

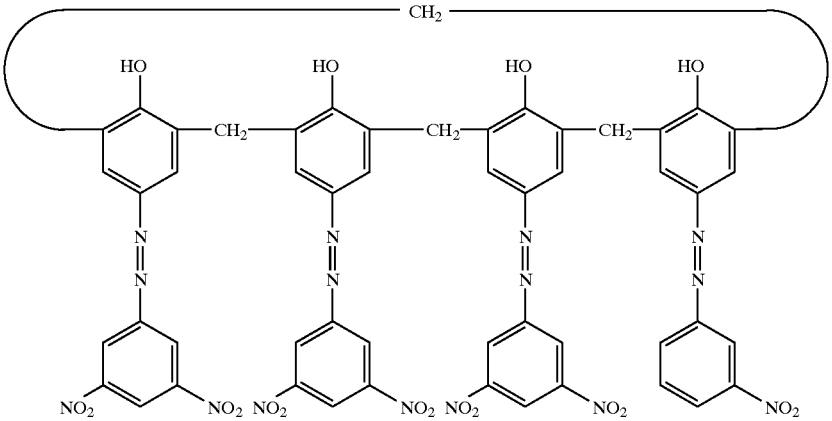

Evaluation of Examples 1 to 9 and Comparative Examples 1 to 7:

On the electrophotographic photosensitive members of Examples 1 to 9 and Comparative Examples 1 to 7, light-area potential was measured and evaluation was made on ghost images.

The evaluation was made using a laser beam printer of reversal development system (trade name: LASER JET 4000; manufactured by Hewlett-Packard Co.). This laser beam printer is an electrophotographic apparatus having the construction shown in FIG. 3.

First, in a normal-temperature and normal-humidity environment of 23° C./55%RH, the light-area potential was measured and evaluation was made on ghost images at the initial stage. Thereafter, under the same environmental conditions, a 1,000-sheet paper feed running test was made, and the light-area potential was measured and evaluation was made on ghost images immediately after running and 15 hours after running.

Next, these electrophotographic photosensitive members were left in a low-temperature and low-humidity environment of 15° C./10%RH for 3 days together with the evaluation machine. Thereafter, the light-area potential was measured and evaluation was made on ghost images. Then, under the same environmental conditions, a 1,000-sheet paper feed running test was made, and the light-area potential was measured and evaluation was made on ghost images immediately after running and 15 hours after running.

As conditions for the paper feed running test, it was made in an intermittent mode of 4-sheet printing per minute and a mode in which a running-test pattern having lines of about 0.5 mm wide each, lengthwise drawn at intervals of 10 mm, was printed.

The evaluation on ghost images was made in the following way.

For ghost images, a pattern of black squares of 5 mm square each was printed by any number corresponding to one round of the drum-shaped electrophotographic photosensitive member, and thereafter a whole-area halftone image (an image with a dot density of one dot and one space) and a whole-area white image were printed.

Ghost images were sampled for each development volume of F5 (center value) and F9 (low density) of the machine. Evaluation was visually made and was ranked as shown below, according to the degree of ghost.

Rank 1: Any ghost is not seen at all on any prints.
Rank 2: Ghost is lightly seen on a specific print.
Rank 3: Ghost is lightly seen on all prints.
Rank 4: Ghost is seen on all prints.
Rank 5: Ghost is clearly seen on all prints.

Here, the ranks 3, 4 and 5 were judged that the effect of the present invention was not well attained.

The results of evaluation are shown together in Tables 9 and 10.

TABLE 9

| | Normal temperature/normal humidity | | | | | |
|---|---|---|---|---|---|---|
| | Initial stage | | Immediately after running | | 15 Hours after running | |
| | Light area potential (−V) | Ghost rank | Light area potential (−V) | Ghost rank | Light area potential (−V) | Ghost rank |
| Example: | | | | | | |
| 1 | 90 | 1 | 90 | 2 | 90 | 1 |
| 2 | 95 | 1 | 90 | 2 | 95 | 1 |
| 3 | 80 | 1 | 80 | 2 | 80 | 1 |
| 4 | 90 | 1 | 95 | 1 | 90 | 1 |
| 5 | 95 | 1 | 90 | 2 | 95 | 1 |
| 6 | 90 | 1 | 90 | 2 | 90 | 1 |
| 7 | 135 | 1 | 125 | 2 | 135 | 1 |
| 8 | 110 | 1 | 105 | 1 | 110 | 1 |
| 9 | 80 | 2 | 85 | 2 | 85 | 2 |
| Comparative Example: | | | | | | |
| 1 | 110 | 3 | 95 | 4 | 95 | 3 |
| 2 | 155 | 2 | 135 | 4 | 140 | 3 |

TABLE 9-continued

| | Normal temperature/normal humidity | | | | | |
|---|---|---|---|---|---|---|
| | Initial stage | | Immediately after running | | 15 Hours after running | |
| | Light area potential (−V) | Ghost rank | Light area potential (−V) | Ghost rank | Light area potential (−V) | Ghost rank |
| 3 | 165 | 2 | 170 | 4 | 165 | 3 |
| 4 | 105 | 2 | 105 | 2 | 105 | 2 |
| 5 | 100 | 2 | 100 | 3 | 100 | 2 |
| 6 | 110 | 1 | 105 | 2 | 105 | 1 |
| 7 | 105 | 2 | 105 | 2 | 105 | 2 |

TABLE 10

| | Low temperature/low humidity | | | | | |
|---|---|---|---|---|---|---|
| | Initial stage | | Immediately after running | | 15 Hours after running | |
| | Light area potential (−V) | Ghost rank | Light area potential (−V) | Ghost rank | Light area potential (−V) | Ghost rank |
| Example: | | | | | | |
| 1 | 95 | 2 | 95 | 2 | 95 | 2 |
| 2 | 105 | 2 | 105 | 2 | 105 | 2 |
| 3 | 90 | 2 | 90 | 2 | 90 | 2 |
| 4 | 100 | 2 | 100 | 2 | 100 | 2 |
| 5 | 105 | 2 | 105 | 2 | 105 | 2 |
| 6 | 100 | 2 | 100 | 2 | 100 | 2 |
| 7 | 160 | 2 | 150 | 2 | 155 | 2 |
| 8 | 115 | 1 | 120 | 2 | 120 | 1 |
| 9 | 95 | 2 | 95 | 2 | 95 | 2 |
| Comparative Example: | | | | | | |
| 1 | 120 | 4 | 120 | 5 | 120 | 4 |
| 2 | 185 | 4 | 170 | 5 | 175 | 4 |
| 3 | 185 | 4 | 190 | 5 | 190 | 4 |
| 4 | 115 | 3 | 115 | 4 | 115 | 3 |
| 5 | 110 | 3 | 110 | 4 | 110 | 3 |
| 6 | 115 | 2 | 115 | 3 | 115 | 3 |
| 7 | 115 | 3 | 115 | 4 | 115 | 3 |

Example 10

Layers up to the charge generation layer were formed in the same manner as in Example 1.

Next, 7 parts of a charge-transporting material having structure represented by the following formula:

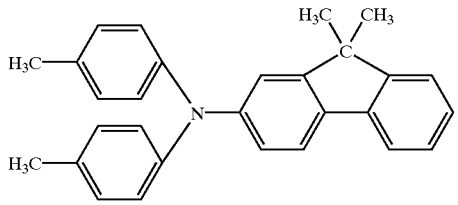

and 10 parts of polycarbonate resin (trade name: EUPILON Z-800; available from Mitsubishi Engineering Plastics Co.) were dissolved in 60 parts of monochlorobenzene to make up a solution. This solution was coated on the charge generation layer by dipping, followed by drying at 110° C. for 1 hour to form a charge transport layer with a layer thickness of 10 μM.

Next, 36 parts of a charge-transporting material having structure represented by the following formula:

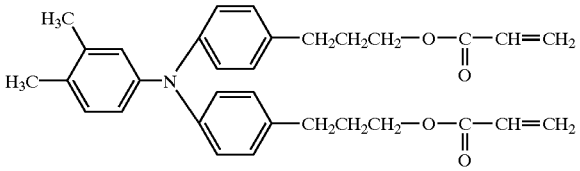

and 4 parts of fine polytetrafluoroethylene particles were mixed in 60 parts of n-propyl alcohol, followed by dispersion treatment to prepare a protective-layer forming coating dispersion.

This coating dispersion was coated on the charge transport layer, and the coating formed was irradiated with electron rays in nitrogen under conditions of an accelerating voltage of 150 kV and a dose of 5 Mrad, subsequently followed by heat treatment for 3 minutes under such conditions that the temperature of what was coated with this protective-layer forming coating dispersion came to 150° C. In this treatment, oxygen concentration was 50 ppm. This was further post-treated at 140° C. for 1 hour in the atmosphere to form a protective layer with a layer thickness of 5 μm. Thus, an electrophotographic photosensitive member of Example 10 was obtained.

Comparative Example 8

An electrophotographic photosensitive member of Comparative Example 8 was produced in the same manner as in Example 10 except that the charge generation layer formed therein was changed to the same charge generation layer as that of the electrophotographic photosensitive member of Comparative Example 4.

Comparative Example 9

An electrophotographic photosensitive member of Comparative Example 9 was produced in the same manner as in Example 10 except that the charge generation layer formed therein was changed to the same charge generation layer as that of the electrophotographic photosensitive member of Comparative Example 1.

Evaluation of Example 10 and Comparative Examples 8 and 9:

On the electrophotographic photosensitive members of Example 10 and Comparative Examples 8 and 9, evaluation was made on ghost images.

The evaluation was made using a laser beam printer loaded with a pulse modulator (trade name: LBP-2000; manufactured by CANON INC). This laser beam printer is an electrophotographic apparatus having the construction shown in FIG. 3, and is remodeled on the following items.

As a light source, a semiconductor laser (manufactured by NICHIA CEMICAL) with an oscillation wavelength of 405 nm is loaded.

Remodeled to a Carlson-method electrophotographic system constituted of charging, exposure, development, transfer and cleaning means, adaptable to image input equivalent to 600 dpi in reversal development.

The photosensitive member surface was also so set as to have a dark-area potential $V_D$ of −650 V and a light-area potential $V_L$ of −200 V.

Evaluation on positive ghost was made in the following way.

A solid black image was reproduced on two sheets of paper. Thereafter, a halftone test chart was reproduced in which square solid black areas of 25 mm square were arranged at its part corresponding to the first round of the electrophotographic photosensitive member from the printed-image beginning part and individual dots were printed in a zigzag pattern at its part corresponding to the second and subsequent rounds of the electrophotographic photosensitive member. The extent of history of the solid black areas of 25 mm square each which appeared on the halftone test chart was visually evaluated. The degree of ghost was quantitated according to ranking criteria as shown below.

Rank A: The outline of history is only very slightly seen.

Rank B: The outline of history is lightly seen.

Rank C: The outline of history is clearly seen.

Here, the ranks B and C were judged that the effect of the present invention was not well attained.

The results of evaluation are shown in Table 11.

TABLE 11

| | Positive ghost |
|---|---|
| Example: | |
| 10 | A |
| Comparative Example: | |
| 8 | B |
| 9 | C |

As described above, according to the present invention, it is possible to provide an electrophotographic photosensitive member which has a high sensitivity, has a high sensitivity especially in the semiconductor laser wavelength region, and also can form images having less image defects such as ghost, not only in a normal-temperature and normal-humidity environment but also in a low-temperature and low-humidity environment; and a process cartridge and an electrophotographic apparatus which have such an electrophotographic photosensitive member.

What is claimed is:

1. An electrophotographic photosensitive member comprising a support and a photosensitive layer provided thereon, wherein said photosensitive layer contains a carixarene compound having structure represented by any one formula selected from the group consisting of the following formulas (1) to (5):

(1)

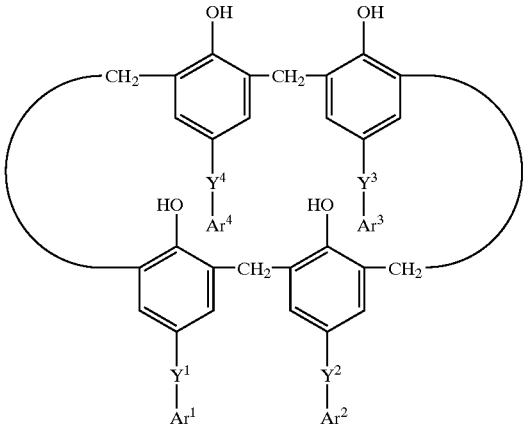

wherein $Y^1$ to $Y^4$ each independently represent —CH═N—, —CH═CH—, —N═N— or —N(O)═N—, and $Ar^1$ to $Ar^4$ each independently represent a substituted or unsubstituted aromatic hydrocarbon ring or a substituted or unsubstituted aromatic heterocyclic ring, provided that a case in which all the $Y^1$ to $Y^4$ are —N═N— and all the $Ar^1$ to $Ar^4$ are the same is excluded;

(2)

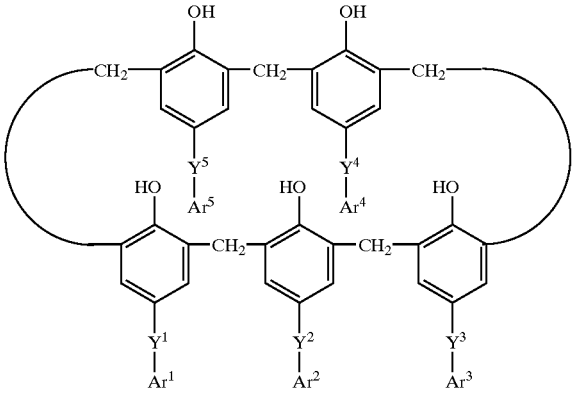

wherein $Y^1$ to $Y^5$ each independently represent —CH═N—, —CH═CH—, —N═N— or —N(O)═N—, and $Ar^1$ to $Ar^5$ each independently represent a substituted or unsubstituted aromatic hydrocarbon ring or a substituted or unsubstituted aromatic heterocyclic ring, provided that a case in which all the $Y^1$ to $Y^5$ are —N═N— and all the $Ar^1$ to $Ar^5$ are the same is excluded;

(3)

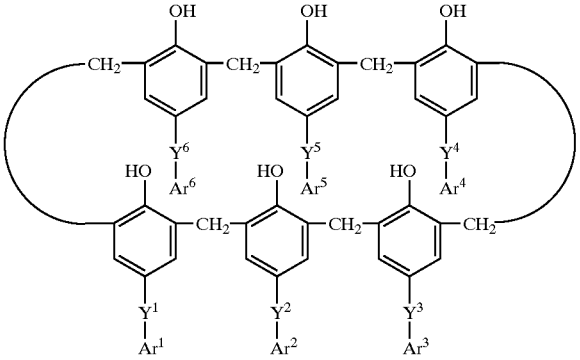

wherein $Y^1$ to $Y^6$ each independently represent —CH═N—, —CH═CH—, —N═N— or —N(O)═N—, and $Ar^1$ to $Ar^6$ each independently represent a substituted or unsubstituted aromatic hydrocarbon ring or a substituted or unsubstituted aromatic heterocyclic ring, provided that a case in which all the $Y^1$ to $Y^6$ are —N═N— and all the $Ar^1$ to $Ar^6$ are the same is excluded;

(4)

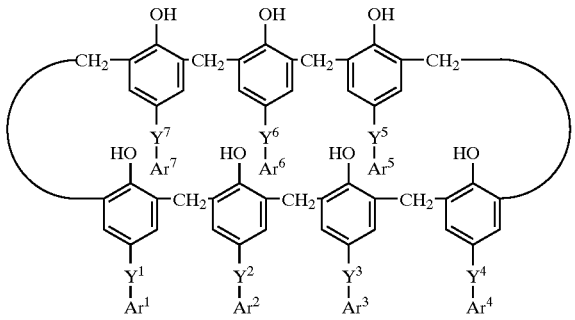

wherein $Y^1$ to $Y^7$ each independently represent —CH═N—, —CH═CH—, —N═N— or —N(O)═N—, and $Ar^1$ to $Ar^7$ each independently represent a substituted or unsubstituted aromatic hydrocarbon ring or a substituted or unsubstituted aromatic heterocyclic ring, provided that a case in which all the $Y^1$ to $Y^7$ are —N═N— and all the $Ar^1$ to $Ar^7$ are the same is excluded; and (5)

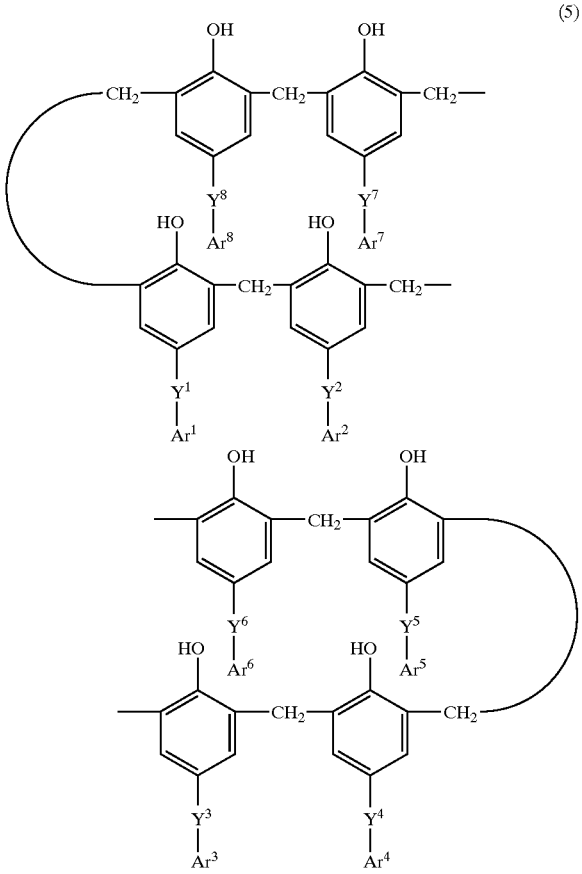

wherein $Y^1$ to $Y^8$ each independently represent —CH═N—, —CH═CH—, —N═N— or —N(O)═N—, and $Ar^1$ to $Ar^8$ each independently represent a substituted or unsubstituted aromatic hydrocarbon ring or a substituted or unsubstituted aromatic heterocyclic ring, provided that a case in which all the $Y^1$ to $Y^8$ are —N═N— and all the $Ar^1$ to $Ar^8$ are the same is excluded.

2. The electrophotographic photosensitive member according to claim 1, wherein said carixarene compound has the structure represented by the formula (1).

3. The electrophotographic photosensitive member according to claim 2, wherein at least one of said $Ar^1$ to $Ar^4$ is a phenyl group having at least one group selected from the group consisting of a cyano group, a nitro group and a halogen atom.

4. The electrophotographic photosensitive member according to claim 3, wherein at least one of said $Ar^1$ to $Ar^4$ is a phenyl group having the nitro group or the cyano group at the meta-position.

5. The electrophotographic photosensitive member according to claim 2, wherein all said $Y^1$ to $Y^4$ are —N═N— and said $Ar^1$ to $Ar^4$ are substituted or unsubstituted phenyl groups of two or more types.

6. The electrophotographic photosensitive member according to claim 1, wherein said carixarene compound has the structure represented by the formula (2).

7. The electrophotographic photosensitive member according to claim 6, wherein at least one of said $Ar^1$ to $Ar^5$ is a phenyl group having at least one group selected from the group consisting of a cyano group, a nitro group and a halogen atom.

8. The electrophotographic photosensitive member according to claim 7, wherein at least one of said $Ar^1$ to $Ar^5$ is a phenyl group having the nitro group or the cyano group at the meta-position.

9. The electrophotographic photosensitive member according to claim 6, wherein all said $Y^1$ to $Y^5$ are —N═N— and said $Ar^1$ to $Ar^5$ are substituted or unsubstituted phenyl groups of two or more types.

10. The electrophotographic photosensitive member according to claim 1, wherein said carixarene compound has the structure represented by the formula (3).

11. The electrophotographic photosensitive member according to claim 10, wherein at least one of said $Ar^1$ to $Ar^6$ is a phenyl group having at least one group selected from the group consisting of a cyano group, a nitro group and a halogen atom.

12. The electrophotographic photosensitive member according to claim 11, wherein at least one of said $Ar^1$ to $Ar^6$ is a phenyl group having the nitro group or the cyano group at the meta-position.

13. The electrophotographic photosensitive member according to claim 10, wherein all said $Y^1$ to $Y^6$ are —N═N— and said $Ar^1$ to $Ar^6$ are substituted or unsubstituted phenyl groups of two or more types.

14. The electrophotographic photosensitive member according to claim 1, wherein said carixarene compound has the structure represented by the formula (4).

15. The electrophotographic photosensitive member according to claim 14, wherein at least one of said $Ar^1$ to $Ar^7$ is a phenyl group having at least one group selected from the group consisting of a cyano group, a nitro group and a halogen atom.

16. The electrophotographic photosensitive member according to claim 15, wherein at least one of said $Ar^1$ to $Ar^7$ is a phenyl group having the nitro group or the cyano group at the meta-position.

17. The electrophotographic photosensitive member according to claim 14, wherein all said $Y^1$ to $Y^7$ are —N═N— and said $Ar^1$ to $Ar^7$ are substituted or unsubstituted phenyl groups of two or more types.

18. The electrophotographic photosensitive member according to claim 1, wherein said carixarene compound has the structure represented by the formula (5).

19. The electrophotographic photosensitive member according to claim 18, wherein at least one of said $Ar^1$ to $Ar^8$ is a phenyl group having at least one group selected from the group consisting of a cyano group, a nitro group and a halogen atom.

20. The electrophotographic photosensitive member according to claim 19, wherein at least one of said $Ar^1$ to $Ar^8$ is a phenyl group having the nitro group or the cyano group at the meta-position.

21. The electrophotographic photosensitive member according to claim 18, wherein all said $Y^1$ to $Y^8$ are —N═N— and said $Ar^1$ to $Ar^8$ are substituted or unsubstituted phenyl groups of two or more types.

22. The electrophotographic photosensitive member according to claim 5, wherein said carixarene compound has structure represented by the following formula (6) or (7):

(6)

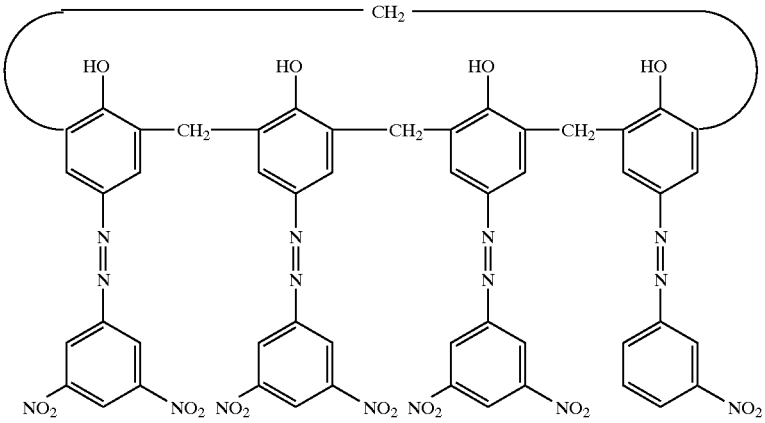

(7)

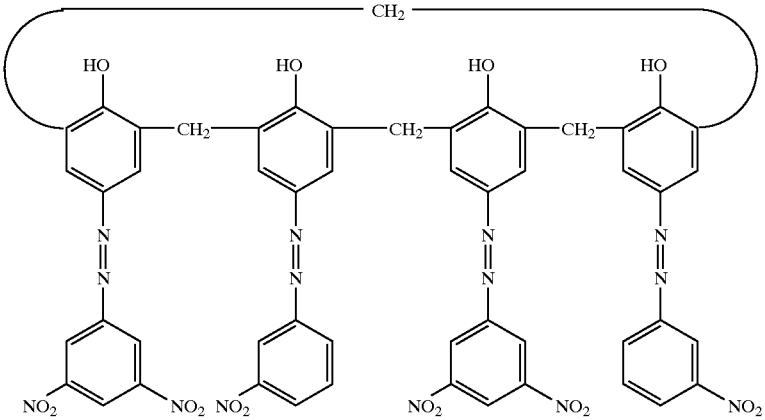

23. The electrophotographic photosensitive member according to claim 22, wherein said carixarene compound has the structure represented by the formula (6).

24. The electrophotographic photosensitive member according to claim 22, wherein said carixarene compound has the structure represented by the formula (7).

25. The electrophotographic photosensitive member according to claim 1, wherein said photosensitive layer contains a phthalocyanine pigment or an azo pigment as a charge-generating material.

26. The electrophotographic photosensitive member according to claim 25, wherein said photosensitive layer contains the phthalocyanine pigment as a charge-generating material.

27. The electrophotographic photosensitive member according to claim 26, wherein said phthalocyanine pigment is an oxytitanium phthalocyanine.

28. The electrophotographic photosensitive member according to claim 27, wherein said oxytitanium phthalocyanine is an oxytitanium phthalocyanine crystal with a crystal form having a strong peak at 27.2±0.2° of the Bragg's angle 2θ in CuKα characteristic X-ray diffraction.

29. The electrophotographic photosensitive member according to claim 28, wherein said oxytitanium phthalocyanine crystal is an oxytitanium phthalocyanine crystal with a crystal form having strong peaks at 9.0°, 14.2°, 23.9° and 27.1° of the Bragg's angle 2θ±0.2° in CuKα characteristic X-ray diffraction.

30. The electrophotographic photosensitive member according to claim 26, wherein said phthalocyanine pigment is a gallium phthalocyanine pigment.

31. The electrophotographic photosensitive member according to claim 30, wherein said gallium phthalocyanine pigment is a hydroxygallium phthalocyanine.

32. The electrophotographic photosensitive member according to claim 31, wherein said hydroxygallium phthalocyanine is a hydroxygallium phthalocyanine crystal with a crystal form having strong peaks at 7.4°±0.2° and 28.2°±0.2° of the Bragg's angle 2θ in CuKα characteristic X-ray diffraction.

33. The electrophotographic photosensitive member according to claim 32, wherein said hydroxygallium phthalocyanine crystal is a hydroxygallium phthalocyanine with a crystal form having strong peaks at 7.3°, 24.9° and 28.1° of the Bragg's angle 2θ±0.2° in CuKα characteristic X-ray diffraction.

34. The electrophotographic photosensitive member according to claim 32, wherein said hydroxygallium phthalocyanine crystal is a hydroxygallium phthalocyanine with a crystal form having strong peaks at 7.5°, 9.9°, 16.3°, 18.6°, 25.1° and 28.3° of the Bragg's angle 2θ±0.2° in CuKα characteristic X-ray diffraction.

35. The electrophotographic photosensitive member according to claim 25, wherein said carixarene compound is in a content of from 0.1% by weight to 10% by weight based on the weight of said charge-generating material.

36. The electrophotographic photosensitive member according to claim 1, wherein said photosensitive layer has at least two layers of a charge generation layer containing said carixarene compound having the structure represented by the formula (1), and a charge transport layer.

37. A process cartridge which integrally supports an electrophotographic photosensitive member and at least one means selected from the group consisting of a charging means, a developing means, a transfer means and a cleaning means, and is detachably mountable to the main body of an electrophotographic apparatus, wherein;

said electrophotographic photosensitive member is an electrophotographic photosensitive member comprising a support and a photosensitive layer provided thereon;

said photosensitive layer containing a carixarene compound having structure represented by any one formula selected from the group consisting of the following formulas (1) to (5):

(1)

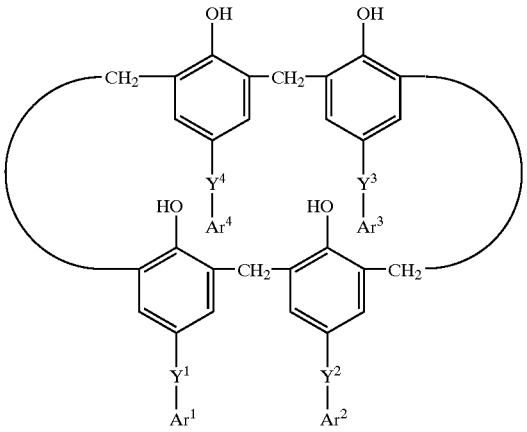

wherein $Y^1$ to $Y^4$ each independently represent —CH═N—, —CH═CH—, —N═N— or —N(O)═N—, and $Ar^1$ to $Ar^4$ each independently represent a substituted or unsubstituted aromatic hydrocarbon ring or a substituted or unsubstituted aromatic heterocyclic ring, provided that a case in which all the $Y^1$ to $Y^4$ are —N═N— and all the $Ar^1$ to $Ar^4$ are the same is excluded;

(2)

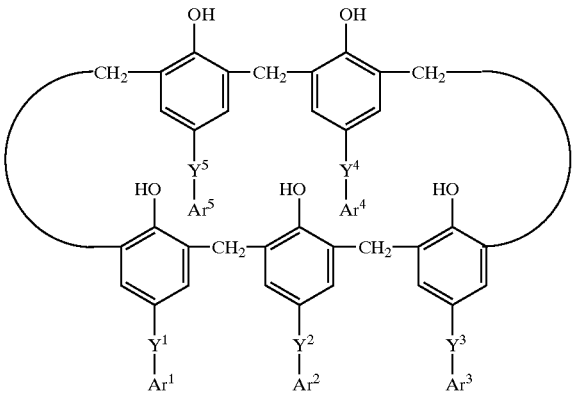

wherein $Y^1$ to $Y^5$ each independently represent —CH═N—, —CH═CH—, —N═N— or —N(O)═N—, and $Ar^1$ to $Ar^5$ each independently represent a substituted or unsubstituted aromatic hydrocarbon ring or a substituted or unsubstituted aromatic heterocyclic ring, provided that a case in which all the $Y^1$ to $Y^5$ are —N═N— and all the $Ar^1$ to $Ar^5$ are the same is excluded;

(3)

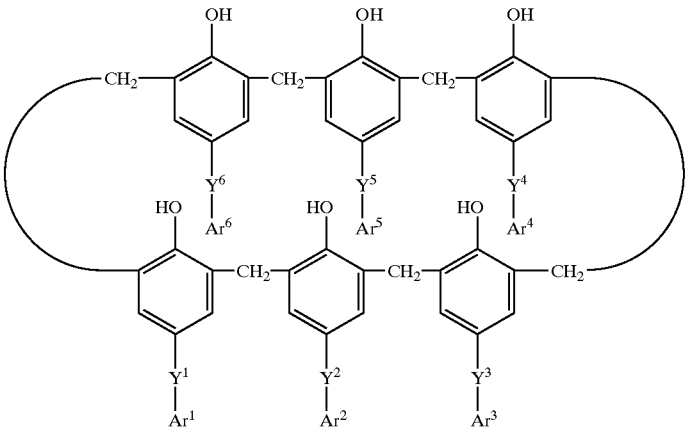

wherein $Y^1$ to $Y^6$ each independently represent —CH═N—, —CH═CH—, —N═N— or —N(O)═N—, and $Ar^1$ to $Ar^6$ each independently represent a substituted or unsubstituted aromatic hydrocarbon ring or a substituted or unsubstituted aromatic heterocyclic ring, provided that a case in which all the $Y^1$ to $Y^6$ are —N═N— and all the $Ar^1$ to $Ar^6$ are the same is excluded;

said electrophotographic photosensitive member is an electrophotographic photosensitive member comprising a support and a photosensitive layer provided thereon;

said photosensitive layer containing a carixarene compound having structure represented by any one formula selected from the group consisting of the following formulas (1) to (5).

(4)

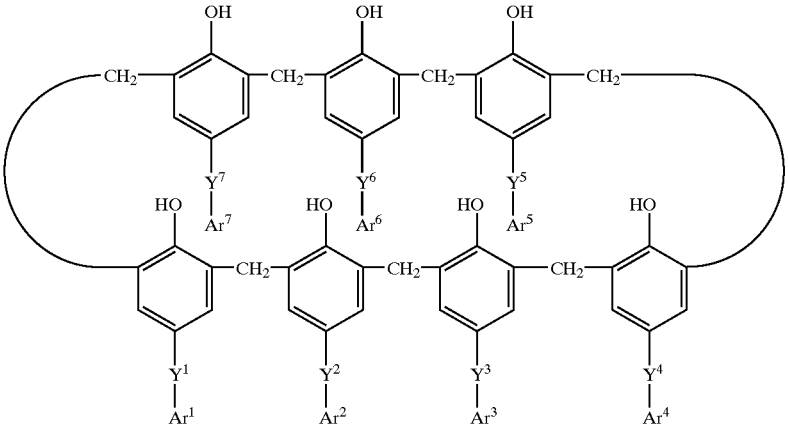

wherein $Y^1$ to $Y^7$ each independently represent —CH═N—, —CH═CH—, —N═N— or —N(O)═N—, and $Ar^1$ to $Ar^7$ each independently represent a substituted or unsubstituted aromatic hydrocarbon ring or a substituted or unsubstituted aromatic heterocyclic ring, provided that a case in which all the $Y^1$ to $Y^7$ are —N═N— and all the $Ar^1$ to $Ar^7$ are the same is excluded; and (5)

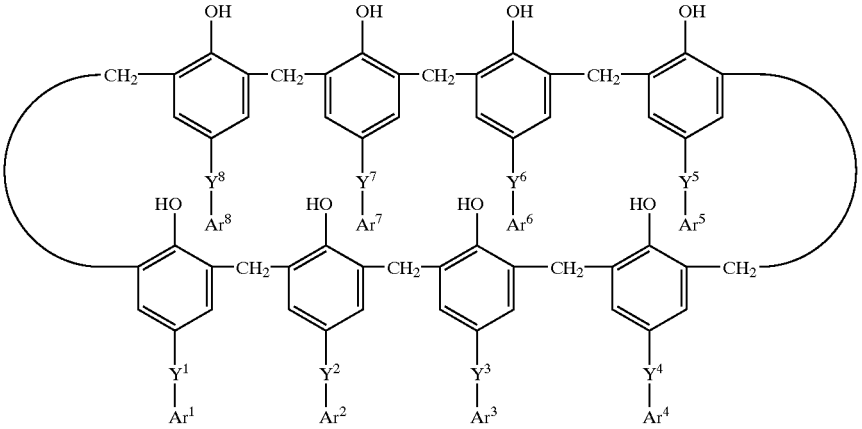

wherein $Y^1$ to $Y^8$ each independently represent —CH═N—, —CH═CH—, —N═N— or —N(O)═N—, and $Ar^1$ to $Ar^8$ each independently represent a substituted or unsubstituted aromatic hydrocarbon ring or a substituted or unsubstituted aromatic heterocyclic ring, provided that a case in which all the $Y^1$ to $Y^8$ are —N═N— and all the $Ar^1$ to $Ar^8$ are the same is excluded.

38. An electrophotographic apparatus comprising an electrophotographic photosensitive member, a charging means, an exposure means, a developing means and a transfer means, wherein;

(1)

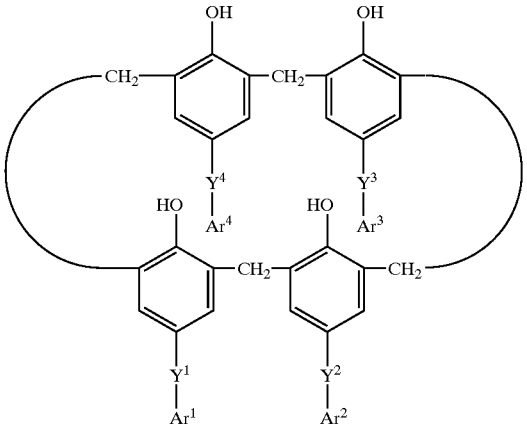

wherein $Y^1$ to $Y^4$ each independently represent —CH═N—, —CH═CH—, —N═N— or —N(O)═N—, and $Ar^1$ to $Ar^4$ each independently represent a substituted or unsubstituted aromatic hydrocarbon ring or a substituted or unsubstituted aromatic heterocyclic ring, provided that a case in which all the $Y^1$ to $Y^4$ are —N═N— and all the $Ar^1$ to $Ar^4$ are the same is excluded;

(2)

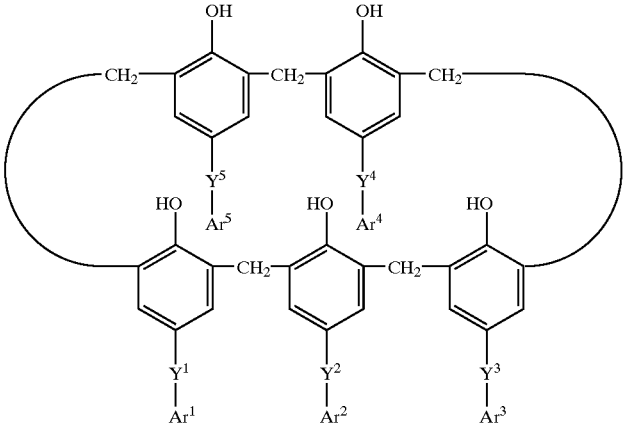

wherein $Y^1$ to $Y^5$ each independently represent —CH═N—, —CH═CH—, —N═N— or —N(O)═N—, and $Ar^1$ to $Ar^5$ each independently represent a substituted or unsubstituted aromatic hydrocarbon ring or a substituted or unsubstituted aromatic heterocyclic ring, provided that a case in which all the $Y^1$ to $Y^5$ are —N═N— and all the $Ar^1$ to $Ar^5$ are the same is excluded;

(3)

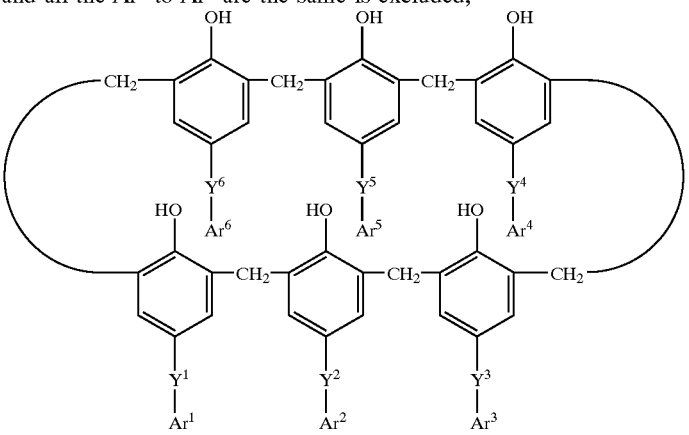

wherein $Y^1$ to $Y^6$ each independently represent —CH═N—, —CH═CH—, —N═N— or —N(O)═N—, and $Ar^1$ to $Ar^6$ each independently represent a substituted or unsubstituted aromatic hydrocarbon ring or a substituted or unsubstituted aromatic heterocyclic ring, provided that a case in which all the $Y^1$ to $Y^6$ are —N═N— and all the $Ar^1$ to $Ar^6$ are the same is excluded;

(4)

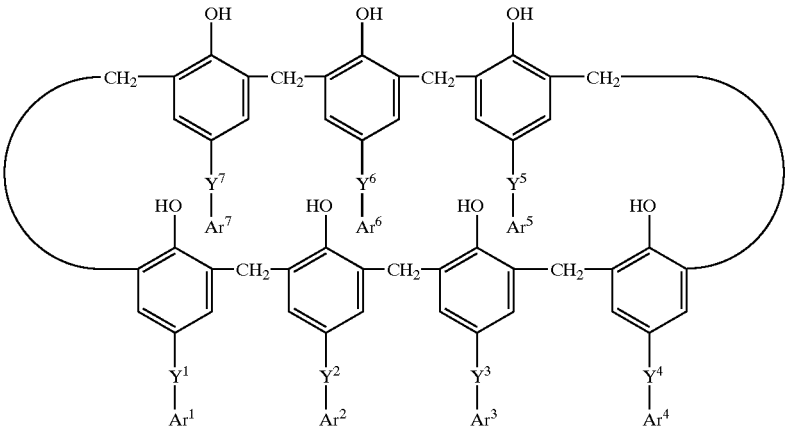

wherein $Y^1$ to $Y^7$ each independently represent —CH═N—, —CH═CH—, —N═N— or —N(O)═N—, and $Ar^1$ to $Ar^7$ each independently represent a substituted or unsubstituted aromatic hydrocarbon ring or a substituted or unsubstituted aromatic heterocyclic ring, provided that a case in which all the $Y^1$ to $Y^7$ are —N═N— and all the $Ar^1$ to $Ar^7$ are the same is excluded; and (5)

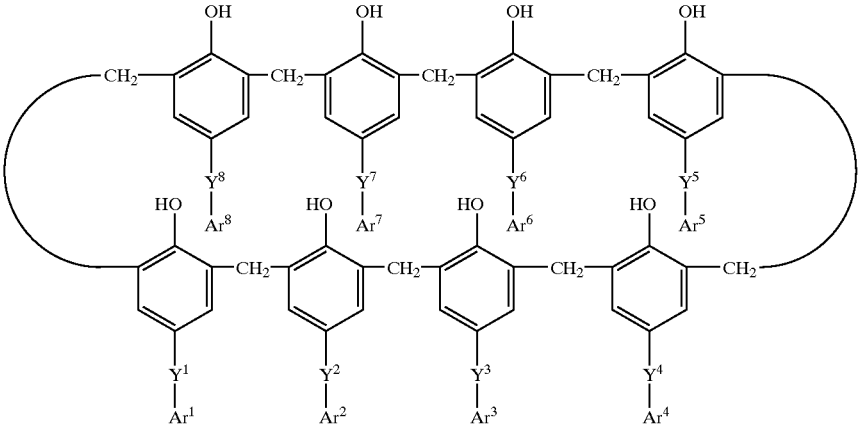

wherein $Y^1$ to $Y^8$ each independently represent —CH═N—, —CH═CH—, —N═N— or —N(O)═N—, and $Ar^1$ to $Ar^8$ each independently represent a substituted or unsubstituted aromatic hydrocarbon ring or a substituted or unsubstituted aromatic heterocyclic ring, provided that a case in which all the $Y^1$ to $Y^8$ are —N═N— and all the $Ar^1$ to $Ar^8$ are the same is excluded.

* * * * *